US007934328B2

(12) United States Patent
Gamble, II

(10) Patent No.: US 7,934,328 B2
(45) Date of Patent: May 3, 2011

(54) V-PLOW CUTTING EDGE INTERFACE

(75) Inventor: Robert N. Gamble, II, Watertown, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 12/485,307

(22) Filed: Jun. 16, 2009

(65) Prior Publication Data

US 2009/0307939 A1 Dec. 17, 2009

Related U.S. Application Data

(60) Provisional application No. 61/073,231, filed on Jun. 17, 2008, provisional application No. 61/073,227, filed on Jun. 17, 2008, provisional application No. 61/073,241, filed on Jun. 17, 2008, provisional application No. 61/073,248, filed on Jun. 17, 2008, provisional application No. 61/073,252, filed on Jun. 17, 2008.

(51) Int. Cl.
*E01H 5/06* (2006.01)

(52) U.S. Cl. ..... 37/273; 172/815

(58) Field of Classification Search ..... 37/272, 37/273, 283, 266, 267, 274, 275, 276, 277, 37/278, 279, 280, 281, 282, 284; 172/815, 172/818, 820

See application file for complete search history.

(56) References Cited

U.S. PATENT DOCUMENTS 509,811 A * 11/1893 Jones ..... 37/273
731,419 A * 6/1903 Wykoff ..... 37/273
956,896 A * 5/1910 Gross ..... 37/273
1,453,811 A * 5/1923 Starkweather ..... 37/273
1,812,186 A * 6/1931 Wood ..... 37/270
1,853,940 A * 4/1932 Soule ..... 37/272
2,059,431 A 8/1934 Barrett et al.
RE20,125 E * 10/1936 Frink ..... 37/271
2,162,635 A * 6/1939 Peereboom ..... 37/273
3,157,099 A * 11/1964 Ulrich ..... 172/815
3,410,008 A 1/1965 Standfuss
3,432,949 A 3/1966 Glesmann
3,378,084 A * 4/1968 Ulrich ..... 172/247
3,436,847 A 4/1969 Grimes
3,466,766 A 9/1969 Kahlbacher
3,526,979 A * 9/1970 Ladewski ..... 37/273
3,851,894 A 12/1974 St. Pierre
3,881,261 A * 5/1975 Lavoie ..... 37/273
3,898,753 A * 8/1975 Kinnunen ..... 37/273
3,987,562 A 10/1976 Deen et al.
4,074,448 A 2/1978 Niemela
4,099,578 A * 7/1978 Stevens ..... 172/815
(Continued)

*Primary Examiner* — Robert E Pezzuto
*Assistant Examiner* — Jamie L McGowan
(74) *Attorney, Agent, or Firm* — Reinhart Boerner Van Deuren s.c.

(57) ABSTRACT

There is provided a v-plow including a first blade and a second blade. Each of the blades are pivotably connected about an axis and moveable through a range of movement. The v-plow includes a pair of wearstrips with one wearstrip coupled to each of the first and second blades. A wearstrip cylinder is coupled to at least one of the wearstrips, with the wearstrip cylinder aligned with the axis. The orientation of the first and second blades, the wearstrips, and the wearstrip cylinder minimize a gap defined between the two blades, throughout the range of movement. Each of the wearstrips include a flange coupled to each of the wearstrips and defining an angle between the flange and the wearstrip. In one embodiment one flange is coupled to the wearstrip cylinder and the other flange is closely adjacent to the wearstrip cylinder, throughout the range of movement of the blades.

23 Claims, 17 Drawing Sheets

U.S. PATENT DOCUMENTS 4,159,584 A * 7/1979 Niemela ..... 37/241
4,436,477 A 3/1984 Lenertz et al.
4,658,519 A 4/1987 Quenzi
4,731,942 A * 3/1988 Eberle ..... 37/272
4,843,744 A 7/1989 Jansen
4,905,387 A 3/1990 Street
4,962,599 A 10/1990 Harris
5,092,409 A 3/1992 Defrancq
5,195,261 A 3/1993 Vachon
5,329,708 A * 7/1994 Segorski et al. ..... 37/231
5,392,864 A 2/1995 Lindenmuth
5,511,328 A * 4/1996 Fingerer et al. ..... 37/285
5,568,694 A 10/1996 Capra et al.
5,638,618 A 6/1997 Niemela et al.
5,819,444 A * 10/1998 Desmarais ..... 37/281
5,829,174 A 11/1998 Hadler et al.
5,894,688 A 4/1999 Struck et al.
5,924,223 A 7/1999 Hone, Jr.
5,960,569 A 10/1999 Molstad
6,035,944 A 3/2000 Neuner et al.
6,044,579 A 4/2000 Hadler et al.
6,088,937 A 7/2000 DeClementi et al.
6,108,946 A 8/2000 Christy
6,145,222 A 11/2000 Curtis
6,151,808 A 11/2000 Curtis
6,154,986 A 12/2000 Hadler et al.
6,178,669 B1 1/2001 Quenzi et al.
6,209,231 B1 4/2001 Curtis
6,240,659 B1 6/2001 Curtis et al.
6,253,470 B1 7/2001 Depies et al.
6,314,666 B1 11/2001 Klemenhagen et al.
6,363,629 B1 4/2002 Curtis
6,408,549 B1 6/2002 Quenzi et al.
6,467,199 B1 * 10/2002 Christy ..... 37/234
6,526,677 B1 3/2003 Bloxdorf et al.
6,557,275 B2 5/2003 Curtis
6,594,924 B2 7/2003 Curtis
6,615,513 B2 9/2003 Quenzi et al.
6,618,964 B2 9/2003 Kost et al.
6,691,435 B1 2/2004 Schultz et al.
6,711,837 B2 3/2004 Bloxdorf et al.
6,775,933 B2 8/2004 Wendorff et al.
6,928,757 B2 8/2005 Bloxdorf et al.
6,941,685 B2 9/2005 Goy et al.
6,944,978 B2 9/2005 LeBlond et al.
6,964,121 B2 11/2005 Harris
7,103,995 B2 9/2006 Curtis
7,117,617 B2 10/2006 Kost et al.
7,146,754 B2 12/2006 Schultz et al.
7,228,650 B2 6/2007 Curtis
7,334,357 B1 2/2008 Altheide
7,353,628 B2 4/2008 Potak
7,437,839 B2 10/2008 Christy et al.
7,481,011 B2 * 1/2009 Nesseth ..... 37/281
7,513,069 B1 4/2009 Gamble, II et al.
2004/0088892 A1 5/2004 Kost et al.
2004/0172858 A1 9/2004 Bloxdorf et al.
2005/0039968 A1 2/2005 Lashua
2005/0076543 A1 4/2005 Curtis
2005/0120595 A1 6/2005 Bloxdorf et al.
2005/0144814 A1 7/2005 Potak
2006/0055150 A1 3/2006 Curtis
2007/0051021 A1 3/2007 Kost et al.
2008/0073090 A1 3/2008 Harris
2008/0115392 A1 5/2008 Musso et al.

* cited by examiner

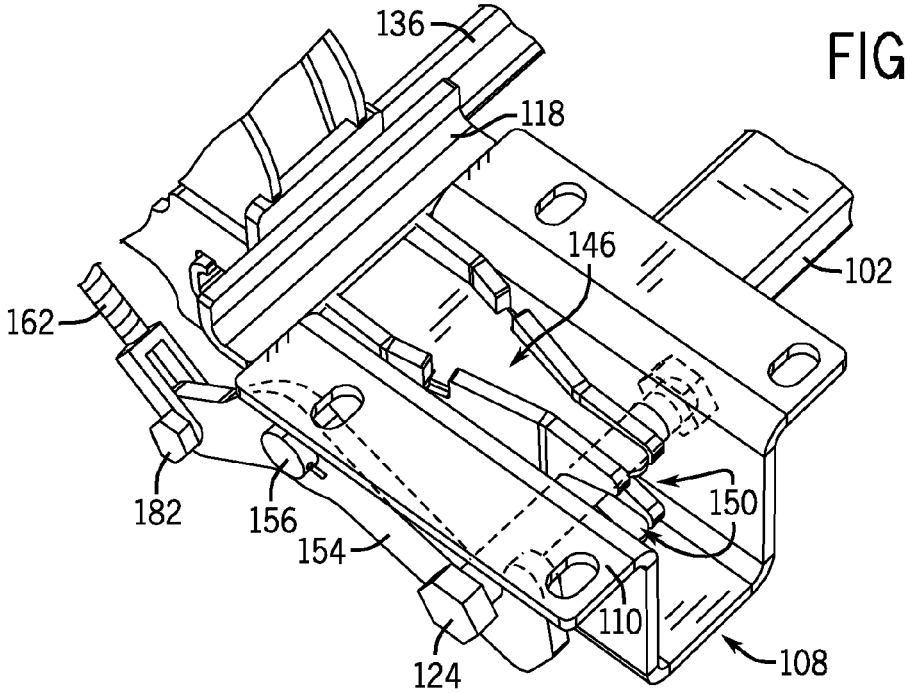
FIG. 10
FIG. 11
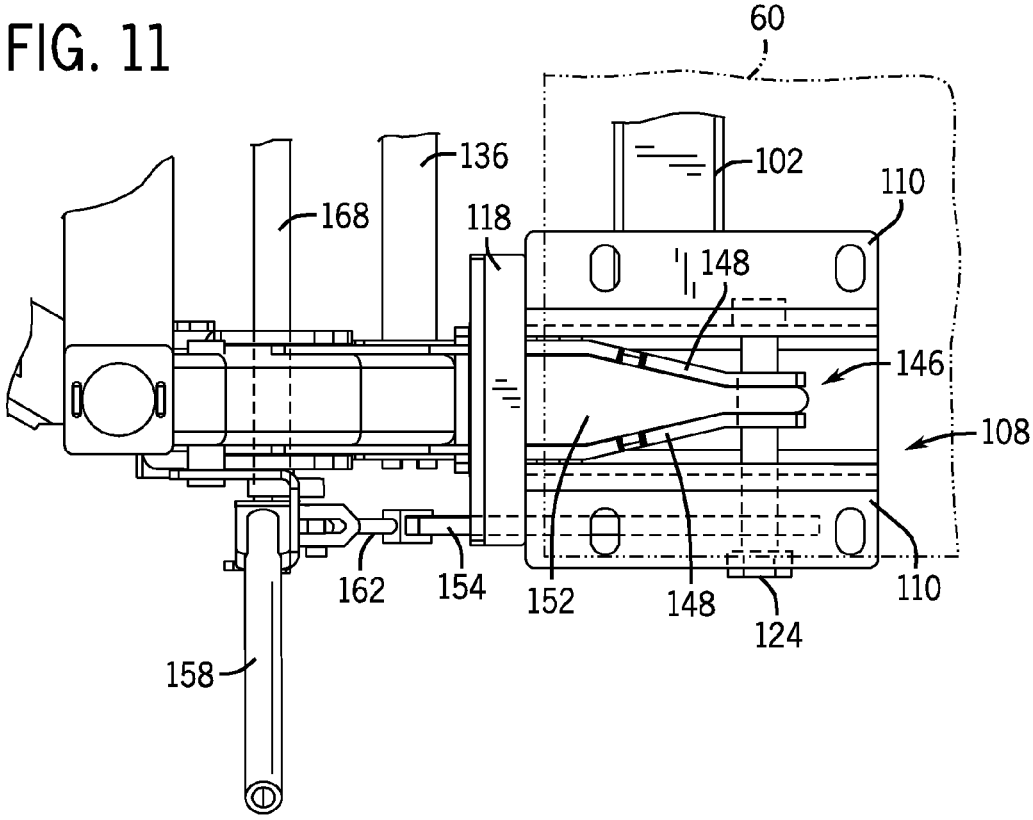

V-PLOW CUTTING EDGE INTERFACE

CROSS REFERENCES TO RELATED APPLICATION

This application claims the benefit of U.S. Provisional Application No. 61/073,231, filed Jun. 17, 2008, which is incorporated herein in its entirety, and is related to U.S. patent application Ser. No. 12/140,732, U.S. patent application No. 12/140,635, U.S. patent application Ser. No. 12/140,671, U.S. patent application Ser. No. 12/140,509, U.S. Provisional Patent Application No. 61/073,227, U.S. Provisional Patent Application No. 61/073,241, U.S. Provisional Patent Application No. 61/073,248, U.S. Provisional Patent Application No. 61/073,252, U.S. patent application Ser. No. 12/140,903, U.S. patent application Ser. No. 12/140,881, U.S. patent application Ser. No. 12/140,466, U.S. patent application Ser. No. 12/140,893, and U.S. patent application Ser. No. 12/140,886 each of which were filed on Jun. 17, 2008 and all of which are incorporated herein in their entirety.

BACKGROUND OF THE INVENTION

Field of the Invention

The present invention relates generally to material handling equipment, and more particularly to a v-plow including independently movable blades.

It is known that plows, for example snow plows, are bolted to supports which are typically welded to the chassis of a vehicle, for example a truck. It is also known that a plow support can be bolted to the chassis of a vehicle. Since plows typically weigh hundreds of pounds, positioning the plow for attachment to the vehicle can be difficult. It is particularly difficult to maneuver a snow plow in the cold and snow of winter.

It is also known to provide a V-Plow in which two blade segments are positioned in a V-shape with the blade segments swept to the rear. Where the blade segments come close together a gap exists through which material, such as snow, can move. It is known, for example, to overlap the blade segments or place a flexible covering in front of the gap. It is also known to provide central straight plow member with blades hinged to the straight plow member to form a V-plow. Such configurations are not satisfactory and need replacement or high maintenance activity.

Accordingly, it is desirable to provide a plow hitch mounting mechanism which is easy to maintain and that the process of connecting and disconnecting the plow to or from the vehicle is simple and easy to use by one person without assistance. It is also desirable to provide a V-plow having a minimum gap between the two V-plow segments and providing an adjustment apparatus to facilitate maintaining the blade bottom edges in horizontal alignment along their length.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, all of the aforesaid advantages should be achieved without incurring any substantial relative disadvantage.

SUMMARY OF THE INVENTION

The disadvantages and limitations of the background art discussed above are overcome by the present invention.

There is provided a v-plow including a first blade and a second blade. Each of the blades are pivotably connected about an axis and moveable through a range of movement. The v-plow includes a pair of wearstrips with one wearstrip coupled to each of the first and second blades. A wearstrip cylinder is coupled to at least one of the wearstrips, with the wearstrip cylinder aligned with the axis. The orientation of the first and second blades, the wearstrips, and the wearstrip cylinder minimize a gap defined between the two blades, throughout the range of movement. Each of the wearstrips include a flange coupled to each of the wearstrips and defining an angle between the flange and the wearstrip. In one embodiment one flange is coupled to the wearstrip cylinder and the other flange is closely adjacent to the wearstrip cylinder, throughout the range of movement of the blades.

There is further provided a snow plow including a hitch frame nose assembly configured to couple to a vehicle. A plow frame is coupled to the hitch frame. A plow tower is connected to the plow frame with the plow frame including a first v-plow blade and a second v-plow blade, with each v-plow blade pivotably coupled to the plow tower with a horizontal pivot pin. The plow tower is configured to support each of the v-plow blades for movement throughout a range of movement about an axis. Each of the first v-plow and second v-plow blade is coupled to a wearstrip. The wearstrip cylinder is coupled to at least one of the wearstrips, with the wearstrip cylinder aligned with the axis. The orientation of the first and second v-plow blades, the wearstrips and the wearstrip cylinder minimize a gap defined between the two v-plow blades throughout the range of movement and wherein the snow plow is pivotably coupled to the vehicle. In another embodiment each of the wearstrips includes a flange finding an angle between the flange and the wearstrip. One flange may be coupled to the wearstrip cylinder and the other flange is closely adjacent to the wearstrip cylinder throughout the range of movement of the blades.

It is further provided a cutting edge interface for a v-plow. The v-plow includes a first blade and a second blade, with the blades coupled together about an axis by a vertical pivot pin and moveable through a range of movement. The cutting edge interface includes a pair of wearstrips with one wearstrip coupled to each of the first and second blade. Each wearstrip is configured with a flange defining an angle between the flange and a straight portion of the wearstrip. A wearstrip cylinder is coupled to at least one of the wearstrips, with the wearstrip cylinder aligned with the axis. The pair of wearstrips and the wearstrip cylinder minimize a gap defined between the two blades. The wearstrips are also configured with one flange coupled to the wearstrip cylinder and the other flange is closely adjacent to the wearstrip cylinder throughout the range of movement of the blades.

The apparatus of the present disclosure is of a construction which is both durable and long lasting, and which will require little or no maintenance to be provided by the user throughout its operating lifetime. The apparatus of the present disclosure is also of inexpensive construction to enhance its market appeal and to thereby afford it the broadest possible market.

DESCRIPTION OF THE DRAWINGS

These and other advantages of the present invention are best understood with reference to the drawings, in which:

FIG. 10 is a detail perspective view of a chassis coupler engaged with a notched member of the hitch frame mechanism illustrated in FIG. 3.

FIG. 11 is a top view of the chassis coupler illustrated in FIG. 10.

DETAILED DESCRIPTION OF THE EXEMPLARY EMBODIMENTS

There is disclosed a snow plow 50 for mounting on a vehicle 60 with a quick connection/disconnect hitch 70 (more fully described below). The quick connect/disconnect hitch 70 facilitates the easy connection, i.e., without tools and disconnection of the snow plow 50 from the vehicle 60.

Figures 1, 2:
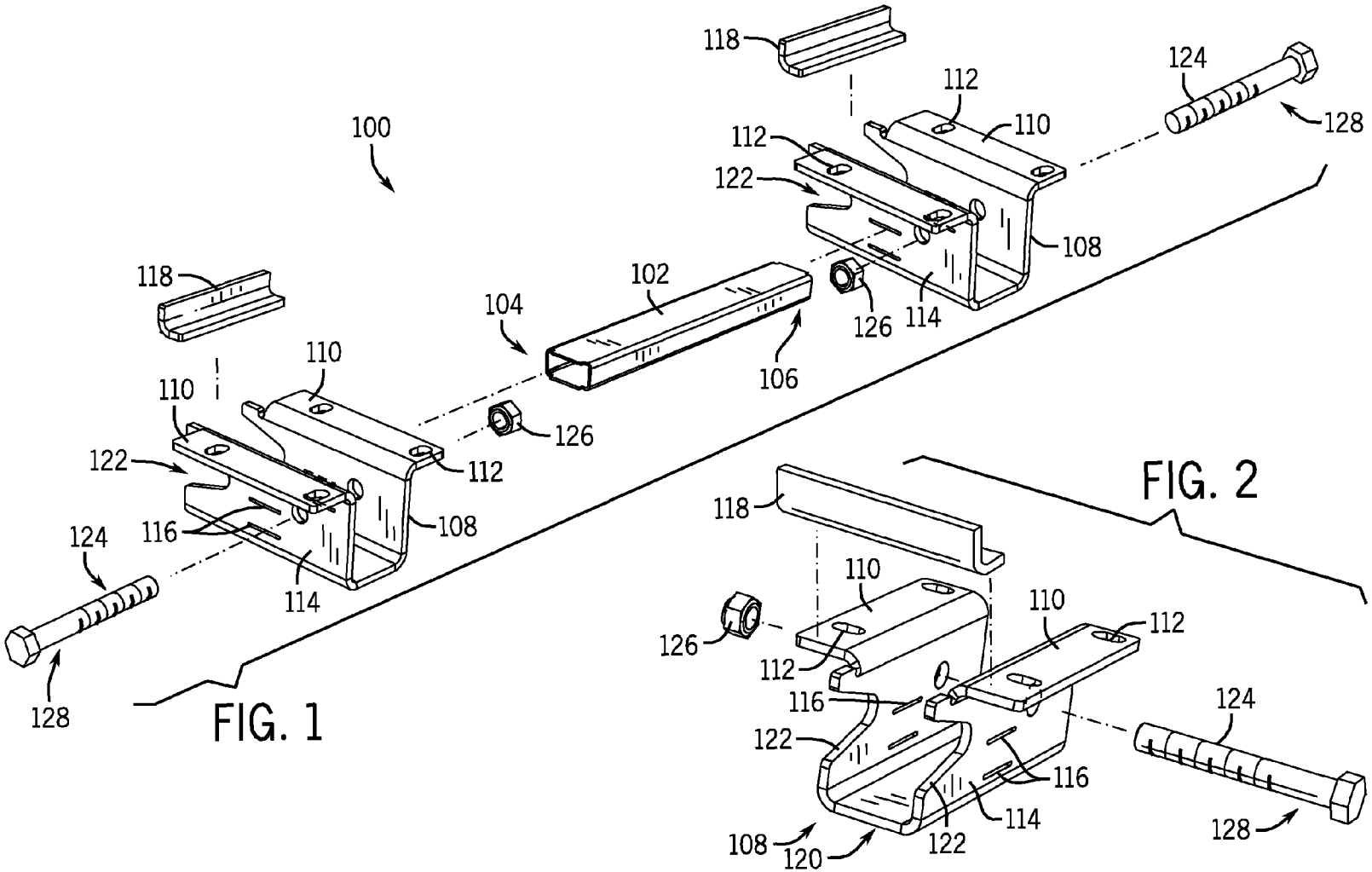
FIG. 1 is an exploded, isometric view of an exemplary embodiment of a hitch frame nose assembly.
FIG. 2 is a detail view of an exemplary embodiment of a chassis coupler of the hitch frame nose assembly illustrated in FIG. 1.

Referring to FIGS. 1 and 2, a hitch frame nose assembly 100 includes a hitch frame tube having a first end 104 and a second end 106. Coupled to each end of the hitch nose tube 102 is a chassis coupler 108. Each chassis coupler 108 mounts to the vehicle chassis 60. In a typical set up, each of the chassis couplers 108 will be secured to a frame member of the vehicle chassis 70 (not shown) by bolting the chassis coupler 108 to the vehicle chassis 60. It is also contemplated that the chassis coupler 108 can be welded to the vehicle chassis 60 as determined by the user of the quick connect/disconnect hitch 70.

Each chassis coupler 108 is a formed U-shaped channel with outward extending flanges. The flanges 110 are configured to provide a mounting surface for the chassis coupler 108 to facilitate coupling of the chassis coupler 108 to the vehicle chassis 60. Each flange 110 defines a plurality of apertures 112 to facilitate bolting of the chassis coupler 108 to the vehicle chassis 60. The apertures 112 may be configured as circles or slots. Each side 114 of each chassis coupler 108 further defines a pair of slots 116 extending longitudinally along and through each side 114 of the chassis coupler 108. The slots 116 facilitate the coupling of the hitch frame tube 102 to each of the chassis couplers 108 comprising the hitch frame nose assembly 100. Each chassis coupler 108 may be provided with slots 116 on each side 114 of the chassis coupler 108 to facilitate manufacturing and assembly by providing commonality of parts. Each chassis coupler 108 is also provided with an end-stop coupled to each of the flanges 110 proximate the front end 120 of the chassis coupler 108. The end-stop 118 assists in positioning the chassis coupler 108 on the vehicle chassis 60. Each chassis coupler 108 also defines a substantially V-shaped notch 122 to accommodate a lock hook pivot more fully described below. Each chassis coupler 108 also includes a traverse pin 124 which extends through both sides 114 of the chassis coupler 108. Traverse pin 124 is secured to the chassis coupler 108 by a nut 126 threadingly fastened to the traverse pin 104. The nut 126 may further be welded to the chassis coupler 108 to further secure the traverse pin 124. A portion 128 of the traverse pin extends beyond the side 114 of the chassis coupler 108 and is configured to engage a locking hook more fully described below.

Figure 3A:
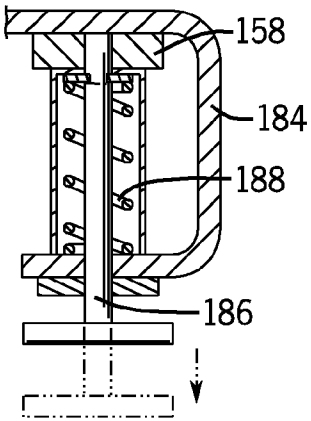
FIG. 3A is a cross-sectional view of an exemplary embodiment of a spring biased retaining pin along the line 3A-3A of FIG. 3.
Figure 3:
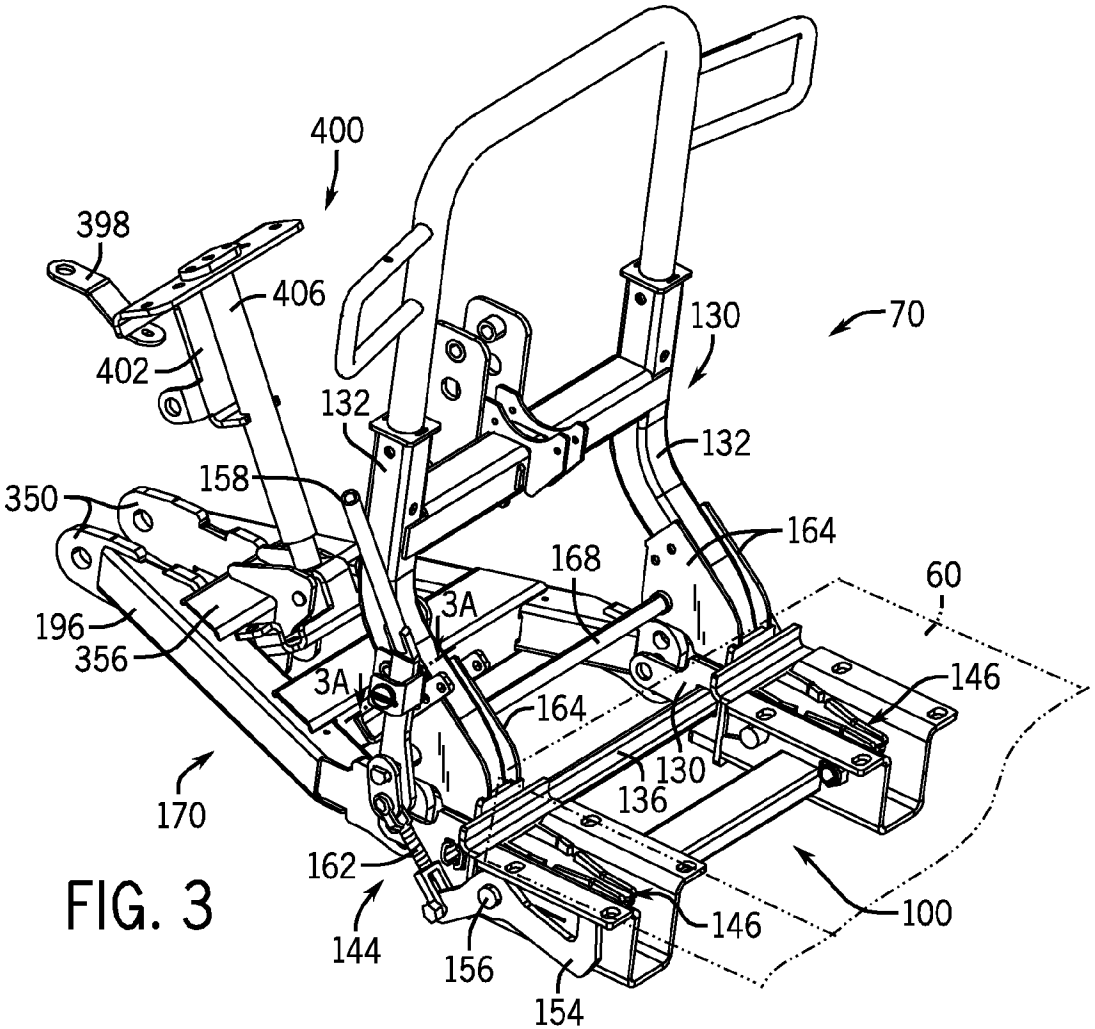
FIG. 3 is an isometric rear view of an exemplary embodiment of a hitch mechanism coupled to a vehicle.

FIG. 3 illustrates an exemplary embodiment of a quick connect/disconnect hitch 70 assembly. The hitch frame nose assembly 100 is coupled to a vehicle chassis 60. Coupled to the hitch frame nose assembly 100 is the lift bar assembly 130 which in turn is coupled to a plow frame 170.

Figure 12:
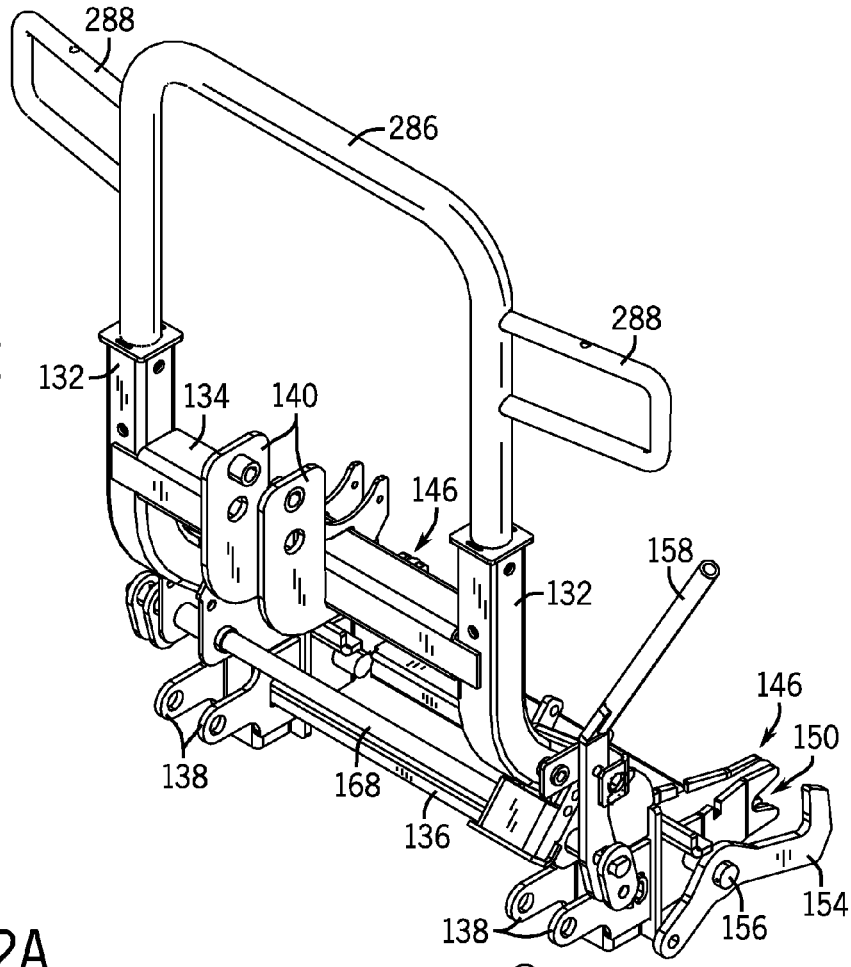
FIG. 12 is an isometric rear view of an exemplary embodiment of a lift bar assembly of the hitch mechanism illustrated in FIG. 3.
Figure 12A:
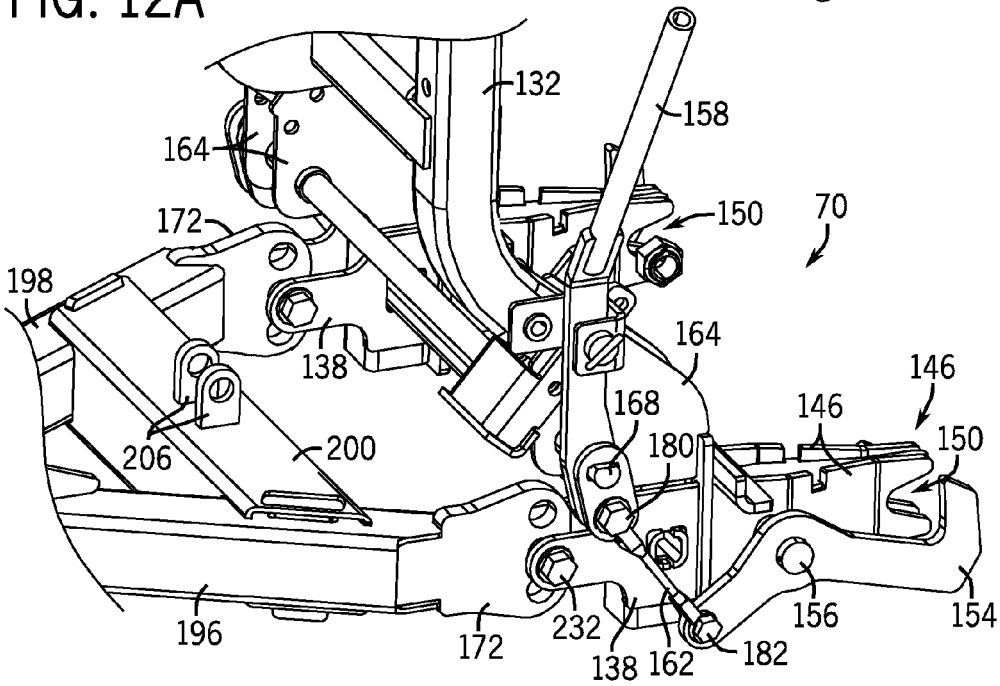
FIG. 12A is a partial view of the lift bar assembly illustrated in FIG. 12, illustrating the lift bar assembly coupled to the rear portion of a plow frame in one of a plurality height adjustment orifices.
Figure 12B:
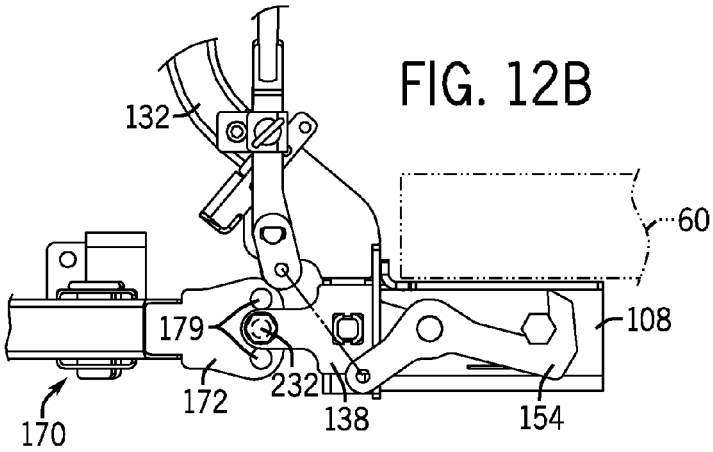
FIG. 12B is a partial side elevation of the hitch mechanism illustrated in FIG. 3.
Figure 12C:
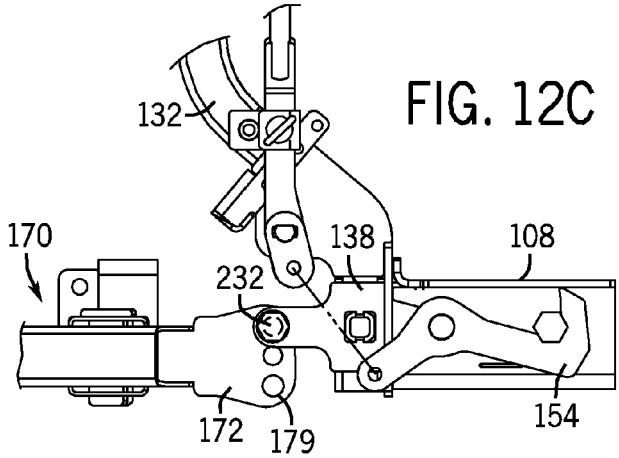
FIG. 12C is a partial side elevation of the hitch mechanism illustrated in FIG. 3 with the lift bar assembly coupled to the plow frame in an alternative height adjustment orifice.

The lift bar assembly 130 includes a pair of lift bar support members 132 maintained in a spaced apart relationship and coupled to a lift bar approximate the top of each lift bar support member 132. A light bar brace 136 approximate the lower end of each lift bar support member 132 facilitates maintenance of the spaced apart relationship of the lift bar support member 132. A pair of lift bar lugs 138 are coupled to each lift bar support member 132 approximate the light bar brace 136. (Also see FIGS. 12 and 12*a*). Coupled to the lift bar 134 are a pair of upper lift cylinder mounts 140 configured to operably secure a power mechanism, for example a lift cylinder 142. Also coupled to the lift bar assembly 130 is a locking mechanism 144.

Figure 4:
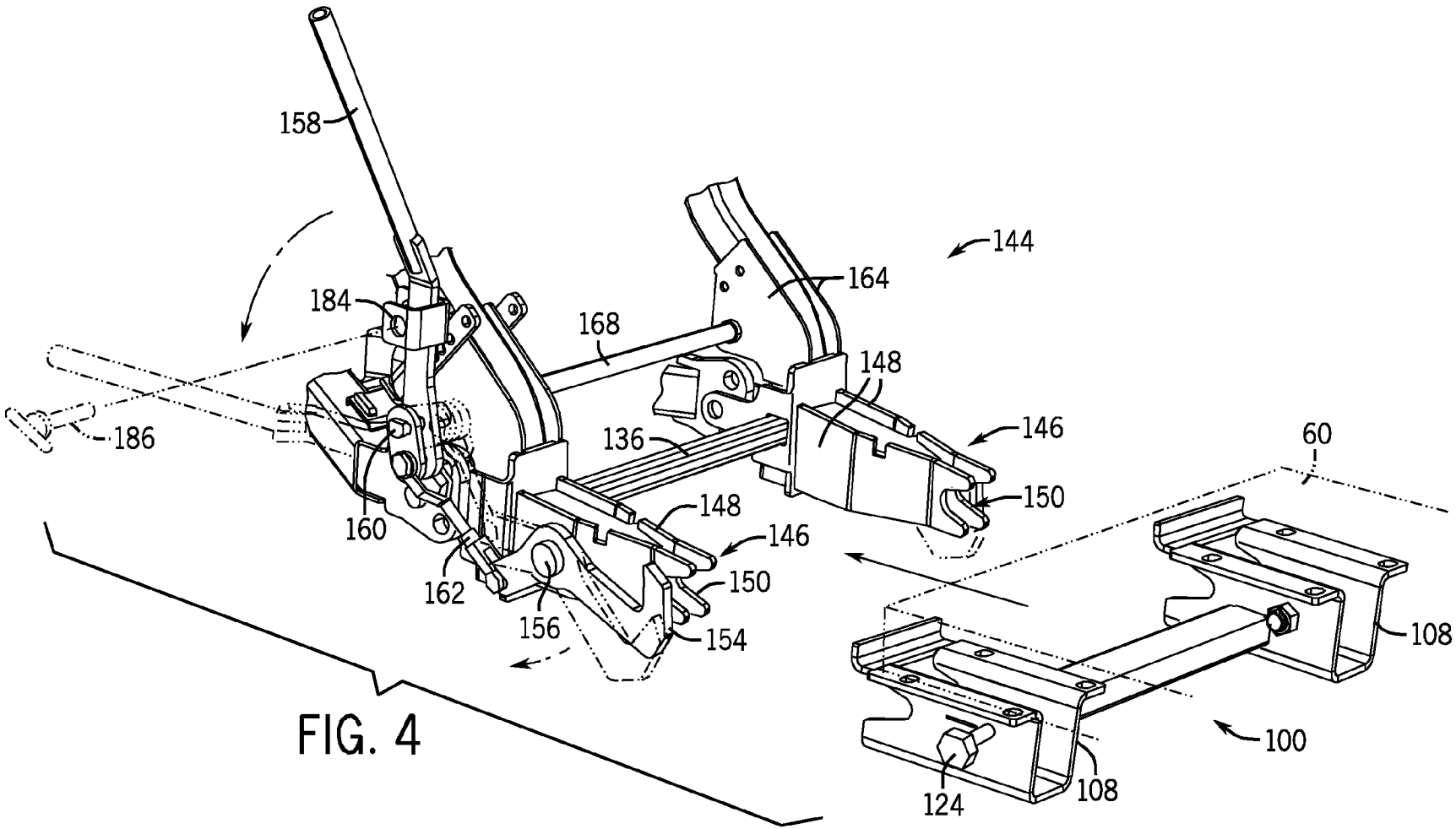
FIG. 4 is an isometric view of the hitch mechanism illustrated in FIG. 3 uncoupled from the hitch frame nose assembly.

Referring to FIG. 4, there is illustrated a hitch frame nose assembly 100 coupled to a vehicle chassis 60 and positioned to receive a locking mechanism 144 of a quick connect/disconnect hitch 70. The locking mechanism 144 includes a pair of notched members 146 coupled to the lift bar assembly 130 and positioned to correspond for engagement with each of the chassis couplers 108 of the hitch frame nose assembly 100.

Each notch member 146 includes a pair of tapered side members 148 with each tapered side member 148 defining a notch 150. Each notch 150 is configured to engage the traverse pin 124 positioned between the two sides 114 of each chassis coupler 108. Each notch member 146 also includes a plate member 152 fastened to the top portion of each of the tapered side members 148, typically by welding a plate member 150 to each tapered side member 148. The plate member provides additional reinforcement for the notch member 146 and defines with the two tapered side members 148 an inverted U-shape assembly. With the notch member 146 engaged with the chassis coupler 108 the pivot for the quick connect/disconnect hitch 70 formed by the engagement of the notch 150 with the traverse pin 124 is enclosed within the two facing u-shaped assemblies.

Each notched member 146 further includes a locking hook 154 pivotably coupled to a hook pivot 156. The hook pivot 156 extends through each of the tapered side members 148 of each notch member 146. The locking hook 154 moves about the hook pivot 156 in response to movement of the hitch locking lever 158 as the hitch locking lever 158 moves about a lever pivot 160. The hitch locking lever 158 is coupled to the locking hook 154 by a lock linkage 162. The operation of the locking mechanism 144 will be explained below.

The orientation of the locking hook 154 and the notch member 146 is such that when the notch member 146 is inserted into the chassis coupler 108 the locking hook is positioned outside of the u-shaped chassis coupler 108 and positioned to selectively engage the portion 128 of the traverse pin 124 that extends beyond the side 114 of the chassis coupler 108. It should be understood that there is a locking hook 154 on each of the notch members 146 which engages the traverse pin 124 extending beyond the side 114 of each of the chassis couplers 108 that are part of the hitch frame nose assembly 100. The locking hook 154 locks the lift bar assembly 130 to the hitch frame nose assembly 100.

Locking mechanism 144 also includes a lock support bracket 164 which is coupled to each of the lift bar support members 132. A preferred embodiment provides that a pair of lock support brackets 164 are coupled to each side of the corresponding lift bar support member 132. (FIGS. 3 and 4) It should be understood that the locking mechanism 144 includes a locking hook 154, hook pivot 156, lock linkage 162 on each outward side of the lift bar assembly 130. On one side of the lift bar assembly 130, the hitch locking lever 158 is coupled to the linkage, and on the other side of the lift bar assembly 130 the lock linkage 162 is coupled to a lock linkage bracket 166. (See FIG. 9). The lock linkage bracket 166 and the hitch locking lever 158 are coupled together by a hitch lock extension rod 168 extending through each of the lock support brackets 164 and each of the lift bar support members 132. The hitch lock lever 158 and the lock linkage bracket 166 are journaled to the hitch lock extension rod 168 by a flat face defined on each end of the hitch lock extension rod 168. (See FIGS. 8 and 9).

Figure 5:
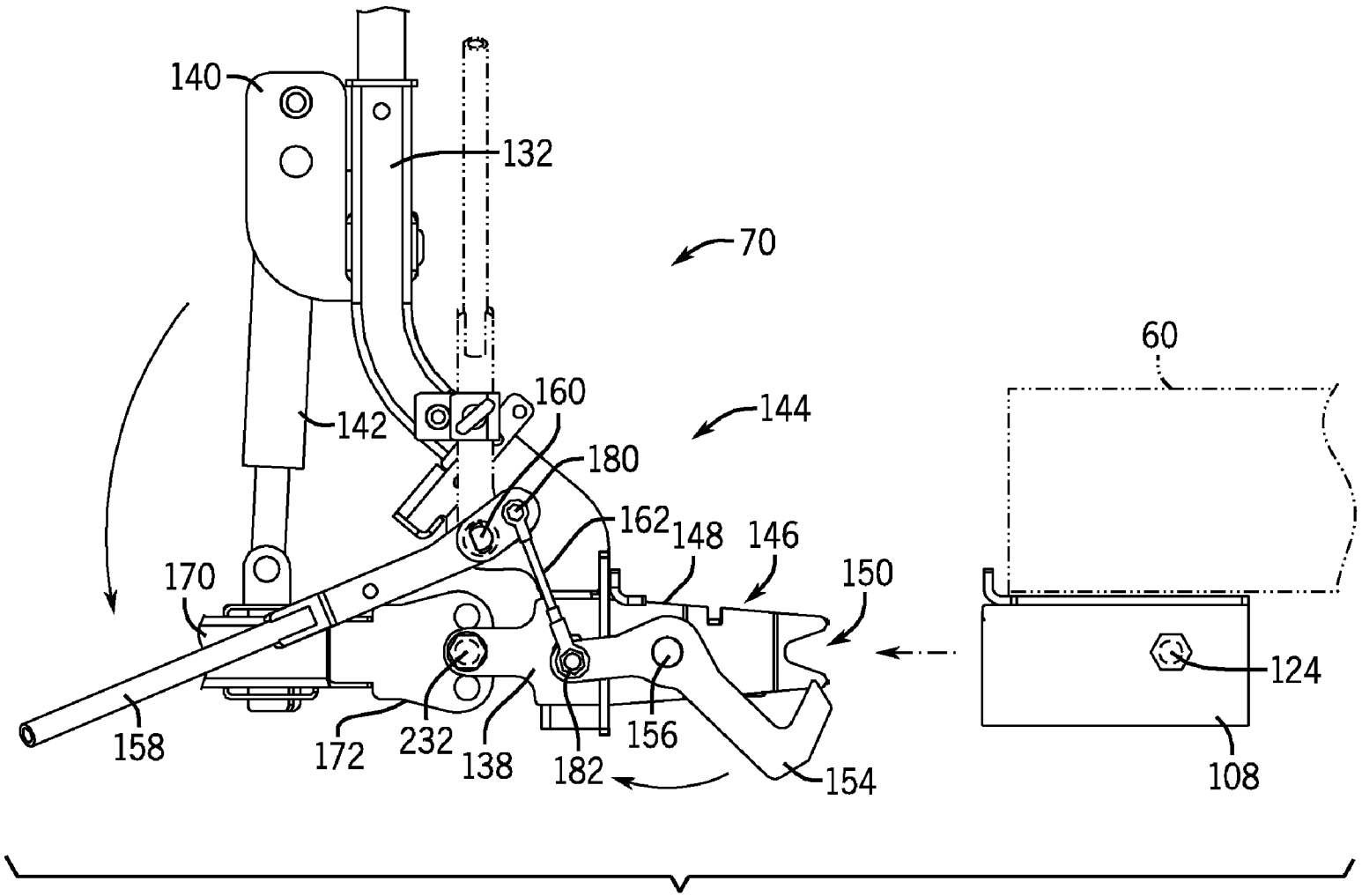
FIG. 5 is a side elevation of the hitch mechanism illustrated on FIG. 4.

The operation of coupling the quick connect/disconnect hitch 70 to the vehicle chassis 60 will now be described with reference to FIGS. 5 through 9. FIG. 5 illustrates an exemplary embodiment of a quick connect/disconnect hitch 70 positioned to engage the hitch frame nose assembly 100 coupled to a vehicle chassis 60. The hitch locking lever 158 is in an unlocked position 174. The movement of the hitch lock lever 158 to the unlocked position 174 rotated the locking hook as illustrated in FIG. 5. The vehicle having a hitch frame nose assembly 100 coupled to the vehicle chassis 60 is moved towards the quick connect/disconnect hitch 70 as indicated by the arrow in FIG. 5.

Figure 6:
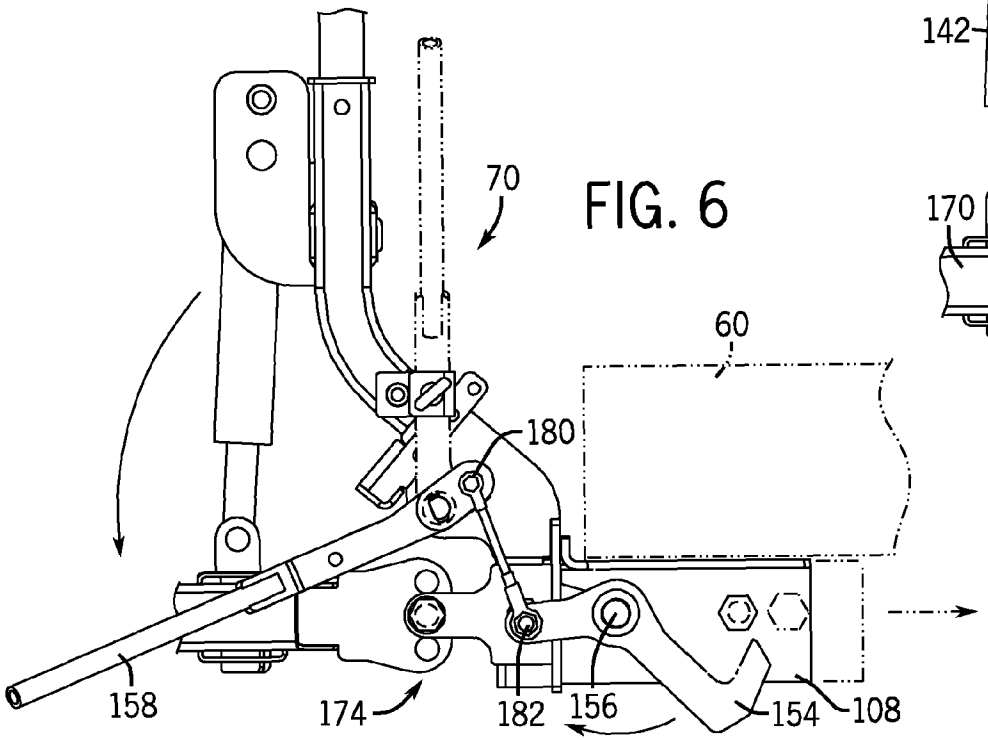
FIG. 6 is a side elevation of the hitch mechanism illustrated in FIG. 3 with the hitch mechanism configured to uncouple from the hitch frame nose assembly.

FIG. 6 illustrates the quick connect/disconnect hitch 70 engaged with the hitch frame nose assembly 100 with each notched member 146 of the lift bar assembly 130 coupled to the traverse pin 124 in each of the chassis couplers 108. Such engagement is illustrated at least in FIGS. 10 and 11. In this position, with the hitch locking lever 158 still in the unlocked position 174 the vehicle can be moved away from the hitch 70 if additional adjustment maneuvers are necessary.

Figure 7:
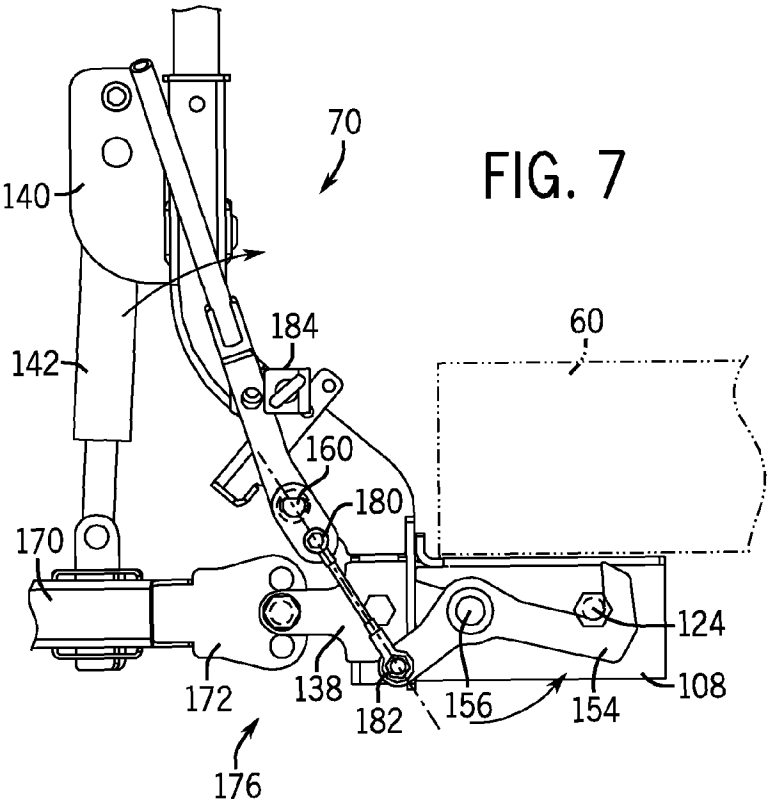
FIG. 7 is side elevation of the hitch mechanism illustrated in FIG. 3 with the hitch mechanism coupled to a chassis coupler of the hitch frame nose assembly and illustrating the hitch locking lever in a first lock position.

FIG. 7 illustrates the locking mechanism 144 in a first locked position 176. In the first locked position 176, the locking hook has moved to engage the traverse pin 124 in each of the chassis couplers 108. In this configuration, the lever pivot 160, the hitch locking lever linkage attachment 180 and the hook linkage attachment 182 are substantially in a straight line as illustrated in FIG. 7.

Figure 8:
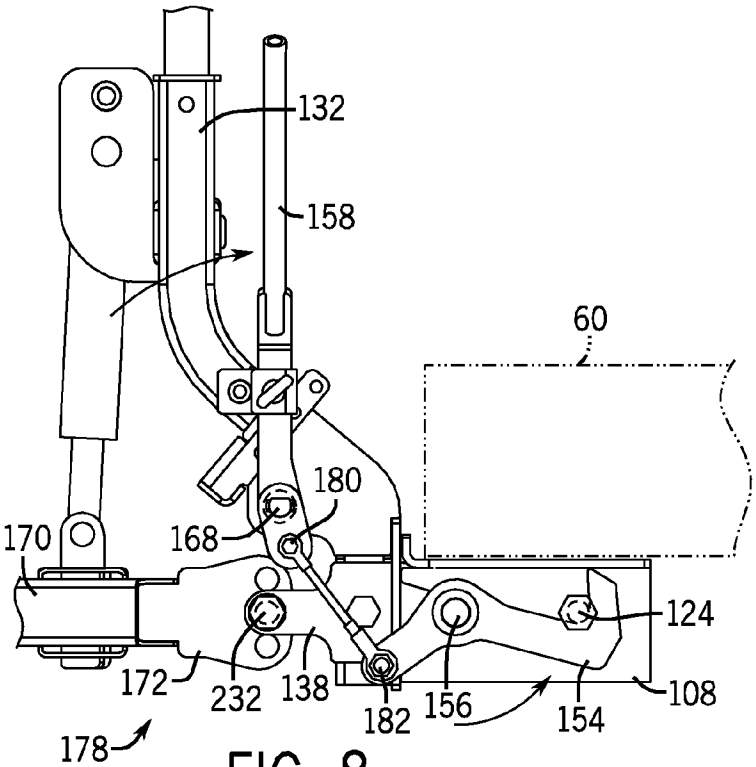
FIG. 8 is a side elevation of the hitch mechanism illustrated in FIG. 7 and illustrating the hitch locking lever in a second lock position.

To complete the locking maneuver of the locking mechanism 144, the hitch locking lever 158 is moved to a second locked position 178 which forces the hitch locking lever 158 to move over center of the lever pivot 160 as illustrated in FIG. 8. The hitch locking lever 158 also is secured in a retaining bracket 184 coupled to a locked support bracket 164. The retaining bracket 184 includes a retaining pin 186 which is biased by a spring 188. The retaining pin 186 engages an orifice defined in the hitch lever locking lever 158 as illustrated in FIG. 3A. It should be understood that other ways of securing the locking lever 158 can be used to prevent the locking lever 158 from inadvertently unlocking the hitch 70.

Figure 9:
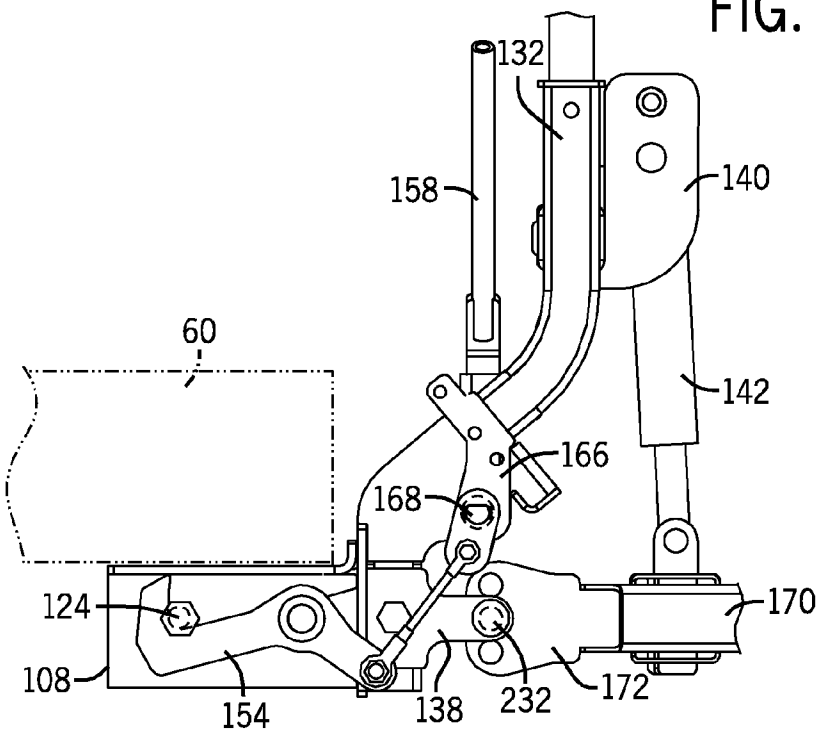
FIG. 9 is a side elevation of another side of the hitch mechanism illustrated in FIG. 8.

As described above, the locking mechanism 144 includes a lock hook 154 on each side of the lift bar assembly 130 and are coupled together to simultaneously operate with movement of the hitch locking lever 158. FIG. 9 illustrates the other side of the locking mechanism 144 illustrated in FIG. 8.

The lift bar assembly 130 is coupled to a plow frame 170. The lift bar assembly 130 is provided with a pair of lift bar lugs 138 coupled to the lift bar brace 136 and to each of the lock support brackets 164 on both sides of the lift bar assembly 130 (see FIG. 12).

A plow frame 170 is configured substantially in the form of a letter A with the plow frame 170 including a front portion 175 and a rear portion 177. The plow frame 170 includes two side member 196, 198 which form the sides of the A-shape with a traverse brace tube 200 coupled to each of the side members 196, 198. A tower traverse brace tube 354 is also coupled to each of the side members 196, 198 and positioned in a spaced apart distance from the traverse brace tube 200 proximate the front portion 175 of the plow frame 170. The side members 196, 198, the tower traverse brace tube 354, and the traverse brace tube 200 are conventional steel square tubing, however, it is contemplated that other cross-section configured tubes, for example circular or triangular, can be used. Coupled to the front portion 175 of the plow frame 170 are a pair of horizontal blade pivot brackets 350. The brackets 350 are coupled to the respective side member 196, 198 and the tower traverse brace tube 356. Each of the brackets 350 defines an orifice 352 configured to receive a horizontal blade pivot pin 370.

Figure 13:
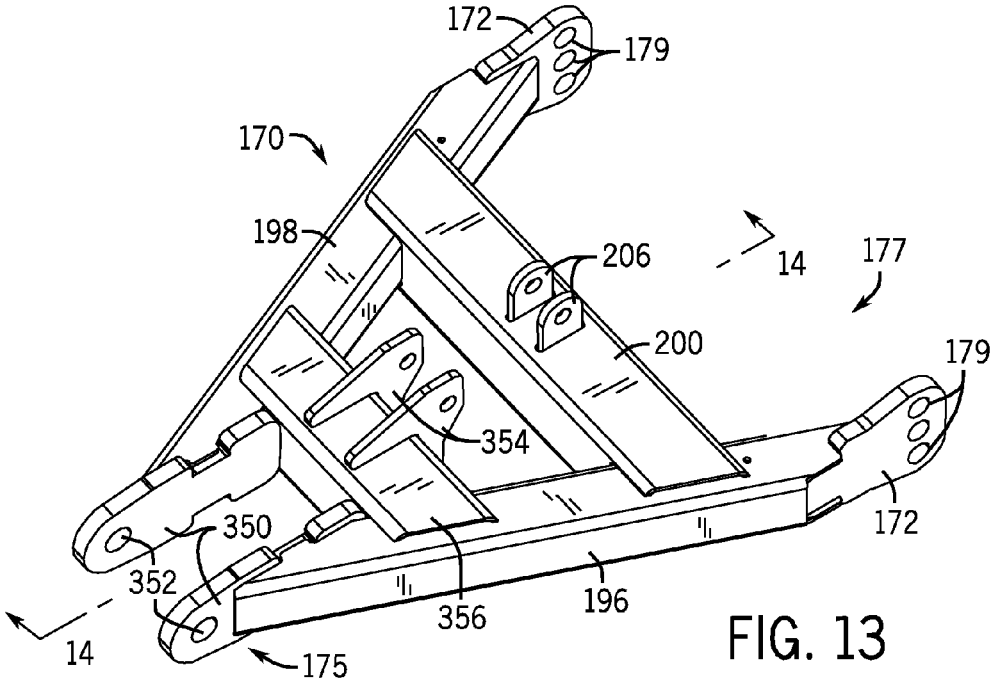
FIG. 13 is an isometric, top, front view of an exemplary embodiment of an A-frame plow frame assembly of the hitch mechanism illustrated in FIG. 3.
Figure 14:
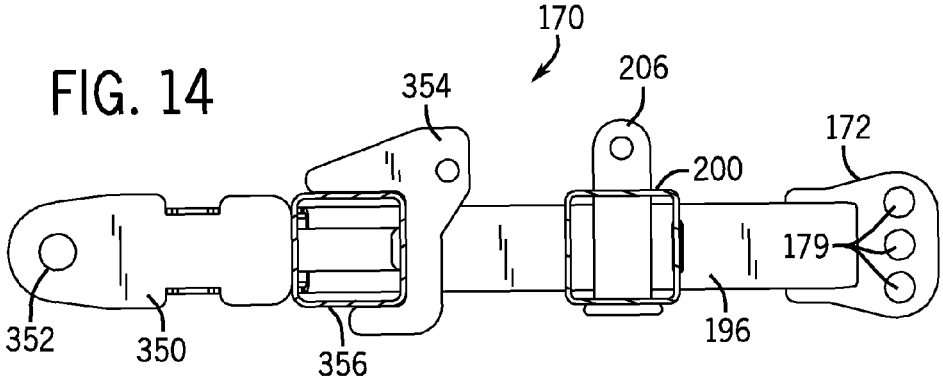
FIG. 14 is a cross sectional view of the plow frame illustrated in FIG. 13 along the line 14-14.
Figure 15:
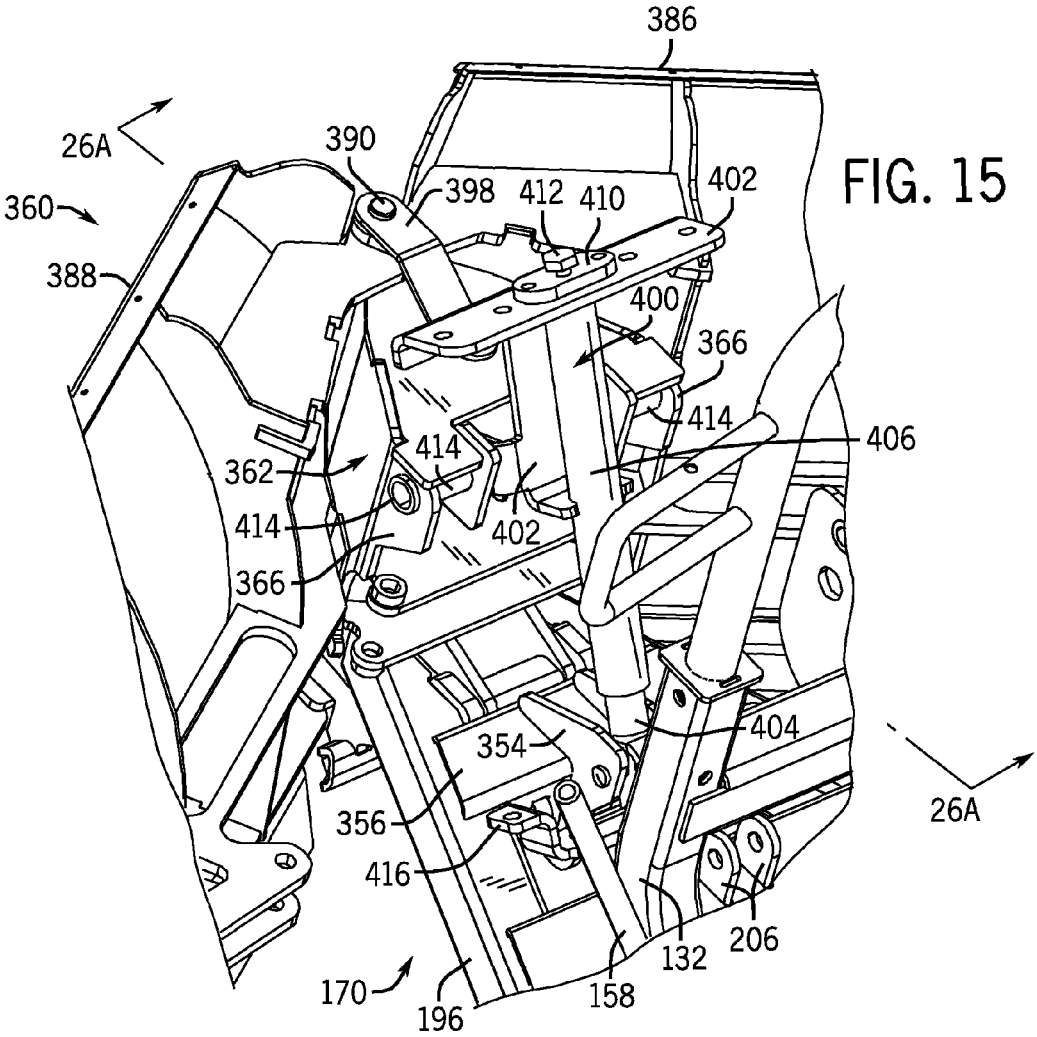
FIG. 15 is a partial rear view of an exemplary embodiment of a plow tower and tower adjustment assembly of the hitch mechanism illustrated in FIG. 3.

A pair of lower tower adjustment brackets 354 are coupled, for example by welding, to the tower traverse brace tube 356. A lower trip spring bracket 416 is coupled to the lower tower adjustment brackets 354. See FIGS. 13, 14 and 23.

Coupled to the traverse brace tube 200 are lift cylinder mounts 206. Lift cylinder mounts 206 are aligned to couple the lower end of the lift cylinder 142 which is coupled to the upper lift cylinder mount 140 on the lift bar 134.

Each of the side members 196, 198 of the plow frame 170 include an adjustment lug 172 at the rear portion 177 of the plow frame 170. Each adjustment lug 172 includes a plurality of orifices 179 aligned vertically and configured to receive a bolt 232 which will couple the plow frame 170 to the lift bar lugs 138 on the lift bar assembly 130. As best seen in FIGS. 12, 12A, 12B, and 12C, the adjustment lug 172 is received between each of the lift bar lugs 138 of the lift bar assembly 130 and secured with a bolt 232. In order to adjust the plow frame height relative to the vehicle, an operator will select one of the vertical adjustment orifices 179 to properly align the plow frame 170 with the lift bar assembly 130 which is in turn coupled with the chassis couplers 108 of the hitch frame nose assembly 100.

Referring now to FIGS. 15-18, there is disclosed a plow tower 362 which is rotatably coupled to the front portion 175 of the plow frame 170. The plow tower 362 is received between the two horizontal blade pivot brackets 350 and coupled to the plow frame 170 with a horizontal blade pivot pin 370 inserted through the horizontal pivot orifice defined in each of the horizontal blade pivot brackets and the orifices 352 and 368 defined in the plow tower 362.

Figure 17:
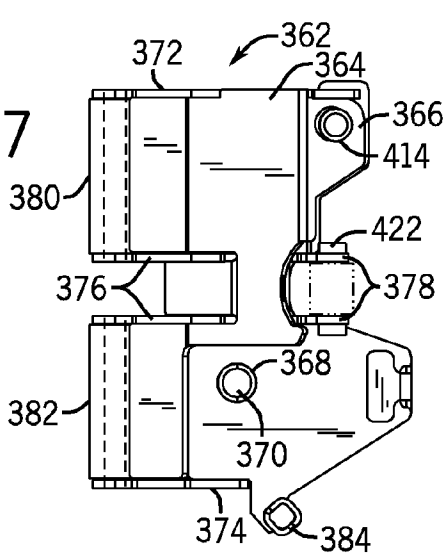
FIG. 17 is a side plan view of an exemplary embodiment of the plow tower illustrated in FIG. 16.
Figure 16:
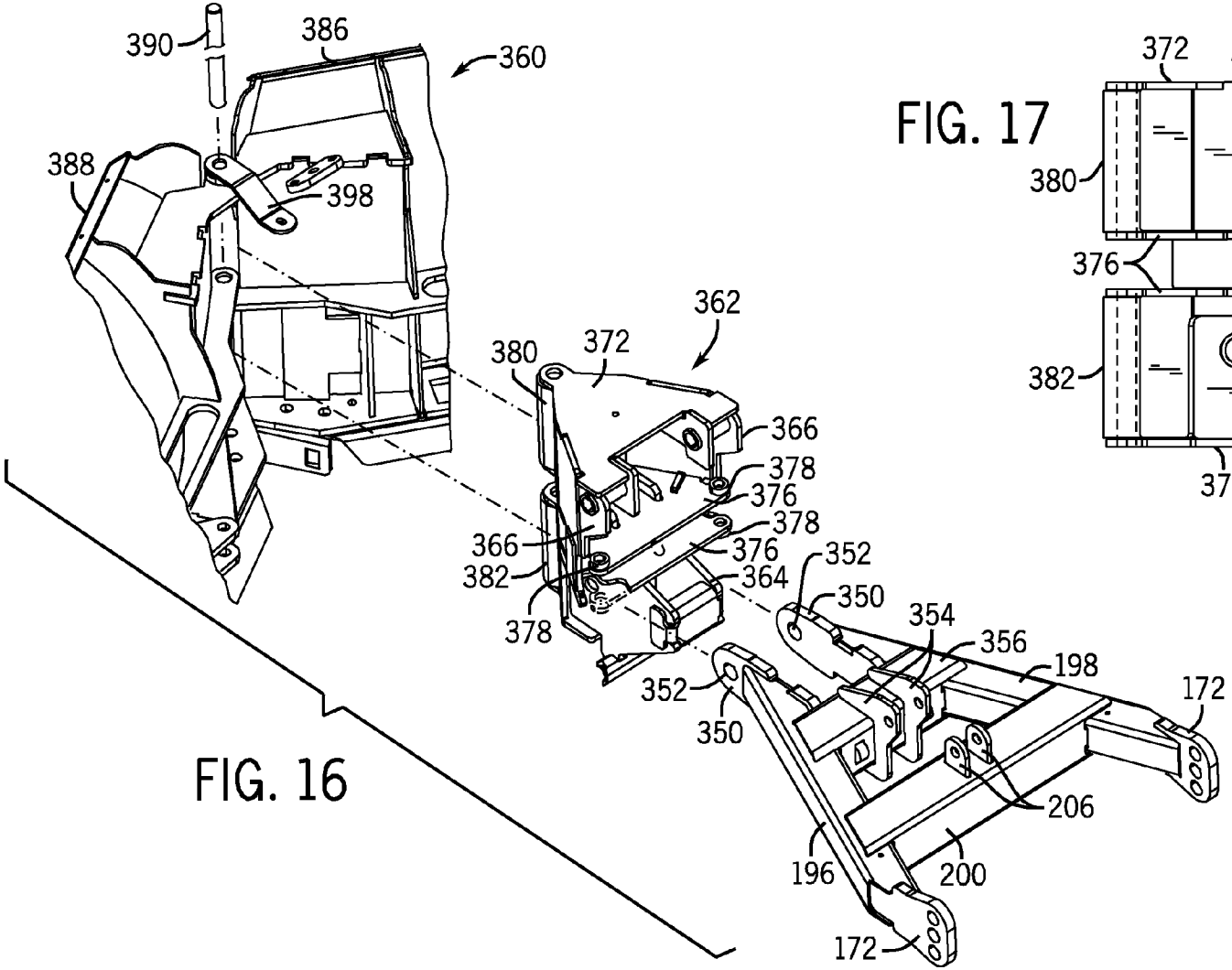
FIG. 16 is an exploded view of the plow frame, plow tower and portions of first and second V-blades illustrated in FIG. 15.
Figure 18:
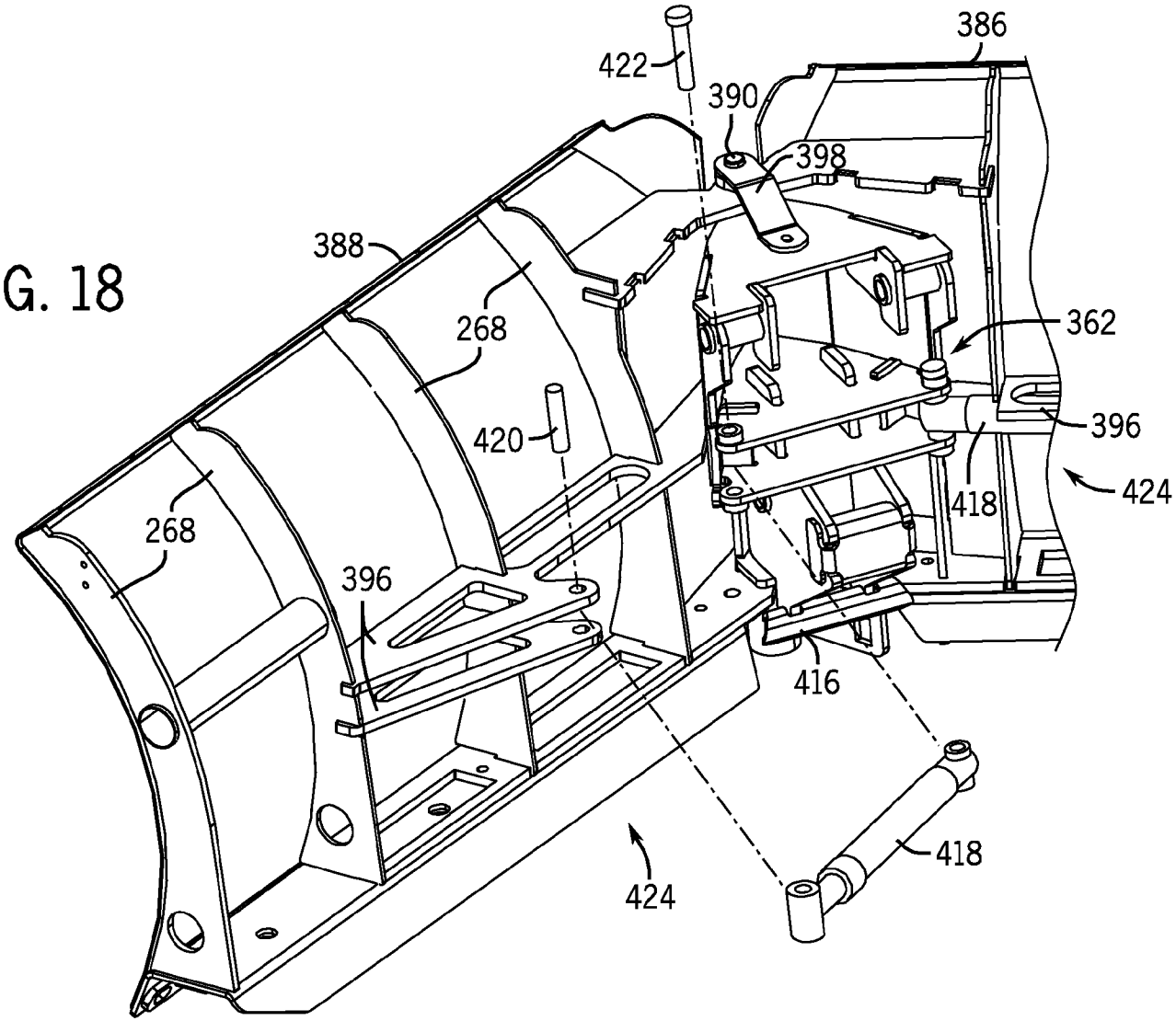
FIG. 18 is an isometric, rear view of one V-plow blade and partial V-plow blade coupled to the plow tower illustrated in FIG. 17 and illustrating an exemplary embodiment of a V-blade actuator.

The plow tower 362 is an assembly of two side plates 364 which are maintained in a triangular configuration by a top plate 372, a lower plate 374 and a pair of intermediate plates 376 as best illustrated in FIGS. 16, 17 and 18. Each of the side plates 364 further define an upper tower adjustment bracket 366, a blade stop 384 and the previously mentioned orifice 368 for the horizontal blade pivot in 370. Coupled between the upper plate 372 and one of the intermediate plates 376 is a blade upper vertical pivot tube 380. Coupled between the lower plate 374 and one of the intermediate blade plates 376 is a lower vertical pivot tube 382. Each of the vertical pivot tubes 380, 382 are coaxial and are positioned at the apex of the triangular-shaped plates, 372, 374, 376. Each of the intermediate plates 376 further define a V-blade swing cylinder bracket 378 which are configured to receive one end of a V-blade swing cylinder 418 and a V-blade swing cylinder pin 422. (See FIG. 17).

A first V-plow blade 386 and a second V-plow blade 388 are coupled together with a blade vertical pivot pin 390 which is received in each of the blade upper vertical pivot tube 380 and lower vertical pivot tube 382. A blade pivot pin tower strap 398 is coupled to the blade vertical pivot pin 390 and the top plate 372 of the plow tower 362.

Figure 24:
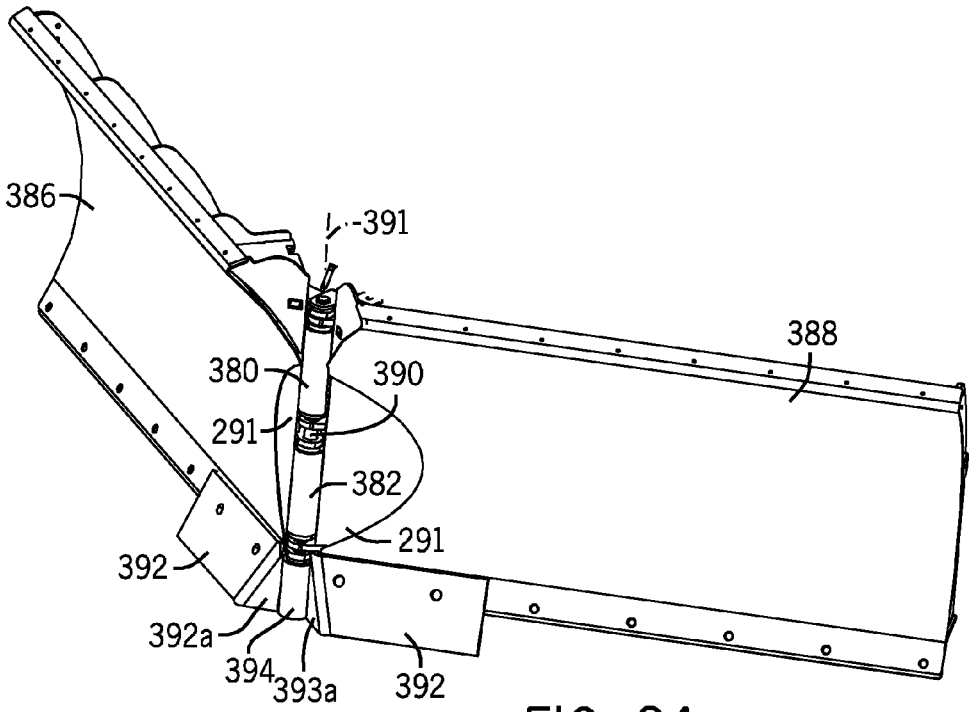
FIG. 24 is an isometric front view of the V-plow blade illustrated in FIG. 23.
Figure 25:
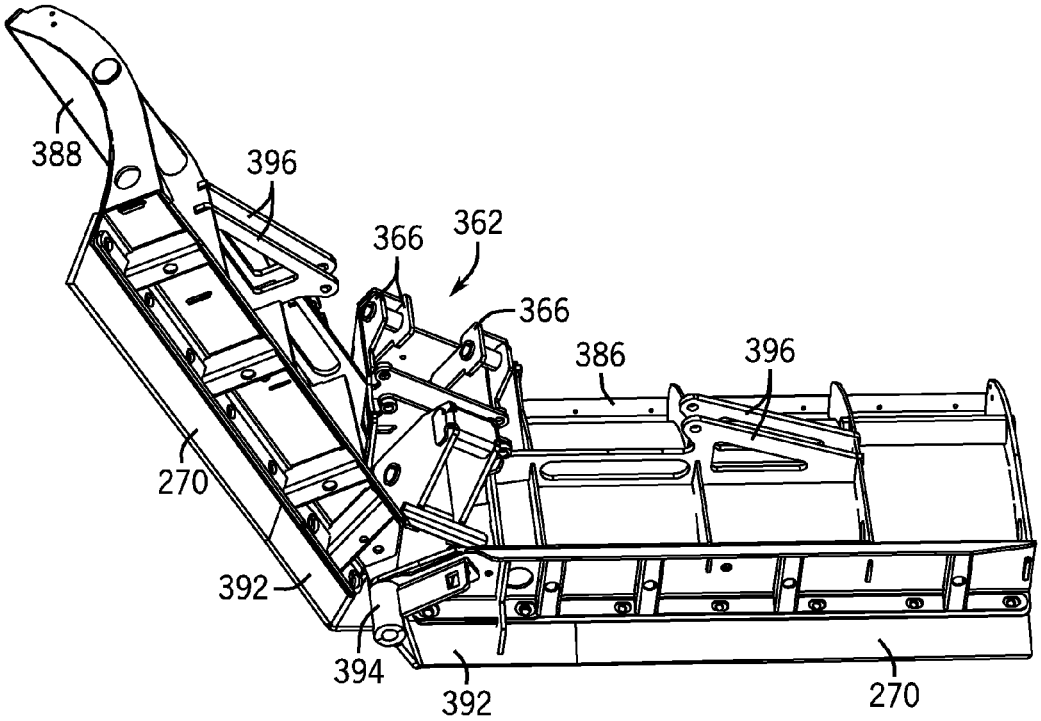
FIG. 25 is an isometric bottom, rear view of the V-plow blade illustrated in FIG. 24.

In a preferred embodiment the blade vertical pivot pin 390 is welded to the blade pivot pin tower strap 398. The orientation of the two V-plow blades 386 and 388 and the vertical pivot tubes 380 and 382 as seen at least in FIGS. 19 and 24 minimize a gap 395 formed between the two blade segments 386, 388. This minimization of the gap 395 inhibits material passing between the blades without requiring an overlap of the two blade segments or providing a cover in front of the hinge formed by the blade vertical pivot pin and the vertical pivot tubes 380, 382.

Each of the V-plow blades 386, 388 include a V-blade actuator 424 which moves each of the V-plow blades 386, 388 into positions as determined by an operator of the snow plow 50.

Each of the V-plow blade actuators 424 include a pair of blade swing cylinder brackets 396 which coupled to the respective V-plow blades 386, 388. One end of the swing cylinder 418 is coupled to the blade swing cylinder bracket 396 by a cylinder pivot pin 420. Another end of the swing cylinder 418 is coupled between each of the intermediate plates 376 by the V-blade swing cylinder pin 422. A fluid supply system (not shown) is coupled to each of the swing cylinders and other power actuators related to the snow plow 50. A preferred embodiment utilizes hydraulic fluid and cylinders.

Figure 19:
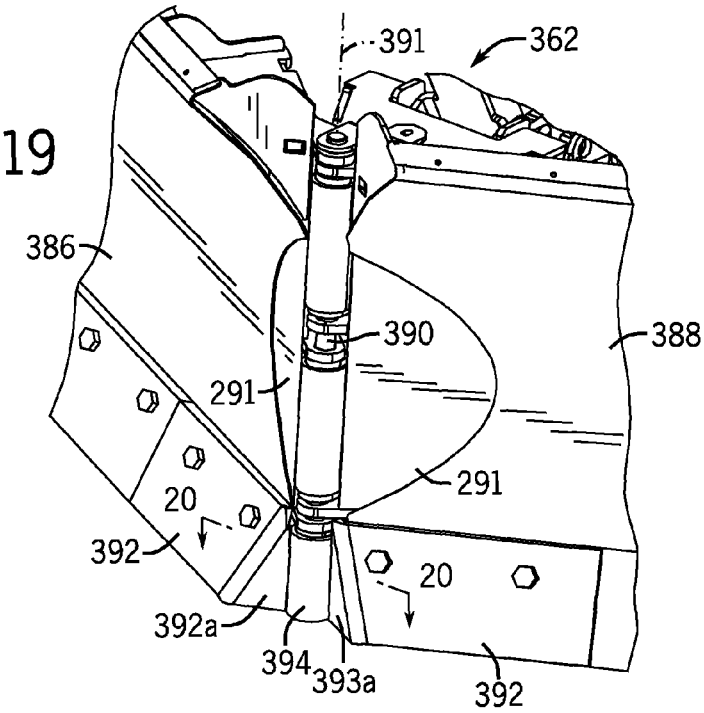
FIG. 19 is a detail front view of an exemplary embodiment of a pivot for the first and second V-blades illustrated in FIG. 18.

FIG. 19 is a detailed view of the front of the V-plow assembly 360. A wearstrip 392, 393 is coupled to each of the first and second V-plow blades 386, 388 approximate the center portion of the blade assembly. The wearstrip tube also referred to as the wearstrip cylinder 394 is coupled to one of the wearstrips 393. It is contemplated that the wearstrip coupled to the tube 394 can be fabricated as part of the wearstrip 393 or it can be coupled to a wearstrip 393 by, for example, welding. It should be understood that the wearstrip cylinder 394 can be coupled to either wearstrip 392, 393. Each of the illustrated wearstrips 392, 393 are bolted to each of the V-plow blades 386, 388. The blade vertical pivot pin 390 extends into the wearstrip through the tube 394 which completes the hinge for the two V-plow blades 386, 388.

Each of the wearstrips 392, 393 may include a flange, 392*a*, 393*a*. See FIGS. 19-22. Each flange and wearstrip defines an angle between the flange and the wearstrip. Each flange may be coupled to a wearstrip, for example by welding, however, in the preferred embodiment the wearstrip and flange are one piece and formed by, for example casting or use of a brake press. It should be noted that in one embodiment one flange 393*a* is coupled to the wearstrip cylinder 394 and the other flange 392*a* is closely adjacent to the wearstrip cylinder 394 throughout the range of movement of the blades. (See FIGS. 20-22).

Figure 20:
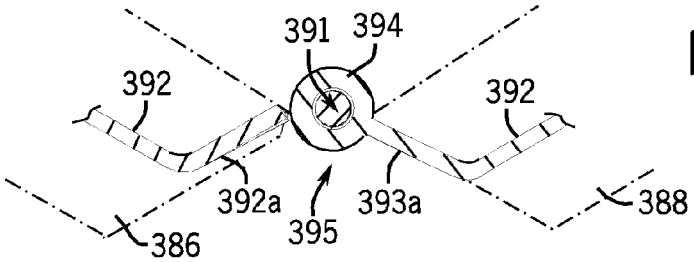
FIG. 20 is a cross-sectional top view of the lower pivot portion along the line 20-20 in FIG. 19 and illustrating the alignment of the first and second V-plow blades in a swept-back position.

Each of the swing cylinders 418 can move each of the V-plow blades 386, 388 into various configurations as determined by an operator of the snow plow 50. FIG. 20 is a cross-sectional top view through the line 20-20 as illustrated in FIG. 19 which shows the wearstrips 392, 393 coupled to each of the V-plow blades 386, 388 with the plow blades in a swept back relationship.

Figure 21:
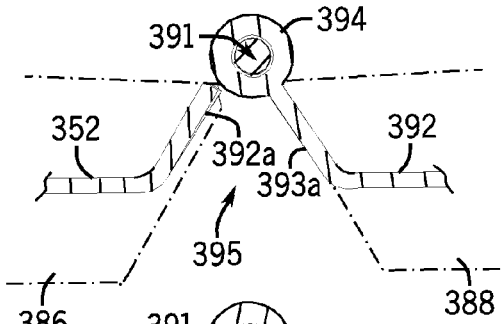
FIG. 21 is a cross-sectional top view of the lower pivot portion along the line 20-20 in FIG. 19 and illustrating the alignment of the first and second V-plow blades in a straight line position.
Figure 22:
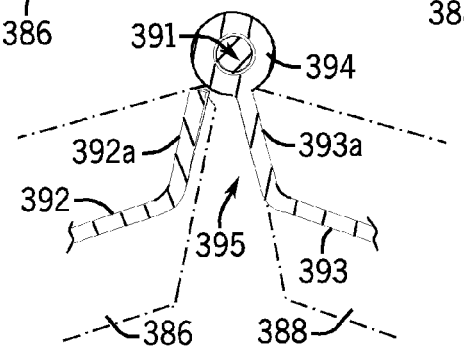
FIG. 22 is a cross-sectional top view of the lower pivot portion along the line 20-20 in FIG. 19 and illustrating the alignment of the first and second V-plow blades in a swept-forward position.

FIG. 21 is the cross-sectional top view of the V-plow blades 386, 388 in a straight configuration. FIG. 22 is a cross-sectional top view of the V-plow blades 386, 388 in a swept forward configuration. FIGS. 20-22 illustrate an exemplary range of movement of the blades 386, 388.

The v-plow 50 may also include a convex bulge 291 defined by each of the first v-plow blade 386 and the second v-plow blade 388 proximate the axis 391, with each convex bulge 291 configured to direct material away from the axis 391. See FIGS. 19 and 24. The v-plow cutting edge interface assembly is configured to minimize passage of material, such as snow, dirt and gravel, through a gap 395 defined by the two blades 386, 388 at the axis 391. The blade upper vertical pivot tube 380, the blade lower vertical pivot tube 382, the wearstrip cylinder 394, the wearstrips 392 and 393 with their respective flanges 392*a*, 393*a* and the vertical pivot pin 390 are configured to substantially close the gap 395 between the two v-plow blades 386, 388 throughout the range of movement of the blades.

It should be noted that in each of the exemplary illustrated plow blade configurations shown in FIGS. 20, 21 and 22 the gap 395 between the plow blades 386, 388 is minimal and effectively inhibits passage of material between the blade segments as the snow plow 50 is moved forward by the vehicle.

Figure 23:
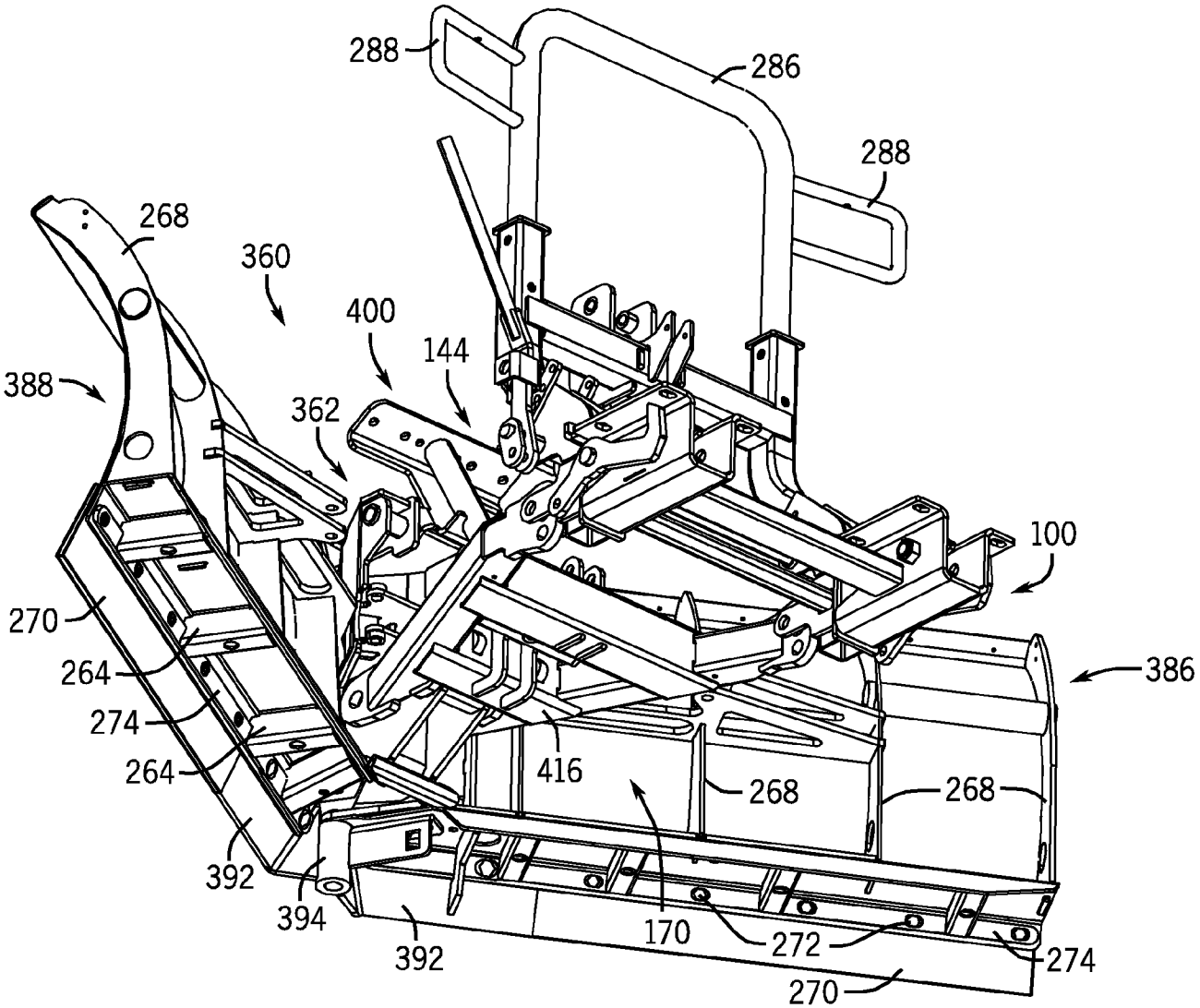
FIG. 23 is an isometric, back view of an exemplary embodiment of a V-plow coupled to the hitch mechanism illustrated in FIG. 3.
Figure 26B:
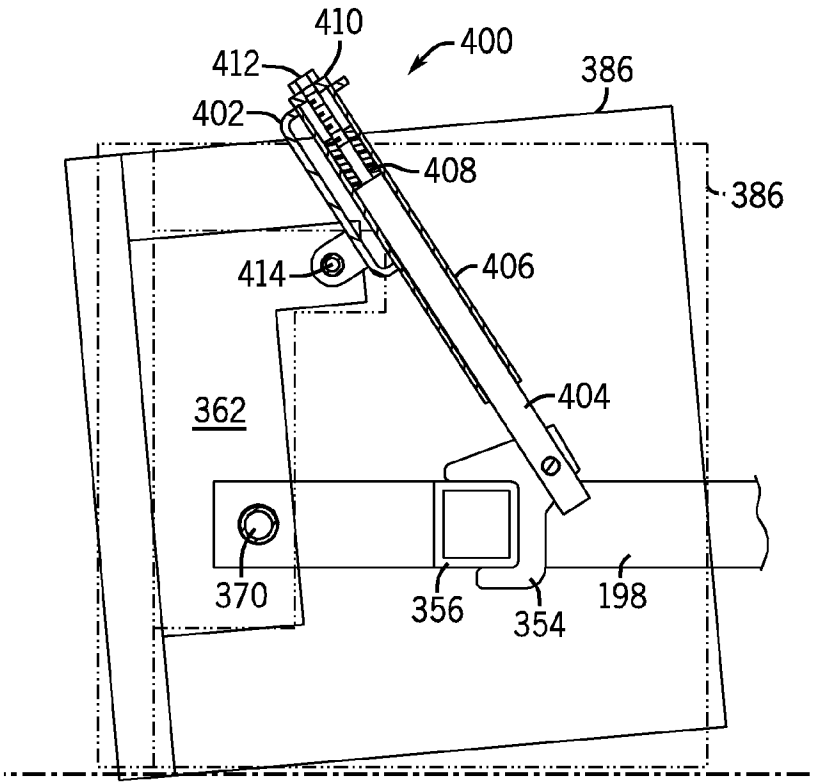
FIG. 26B is a schematic of the tower adjustment assembly rotating the V-plow blade about a horizontal blade pivot pin in the plow tower illustrated in FIG. 26A.
Figure 26A:
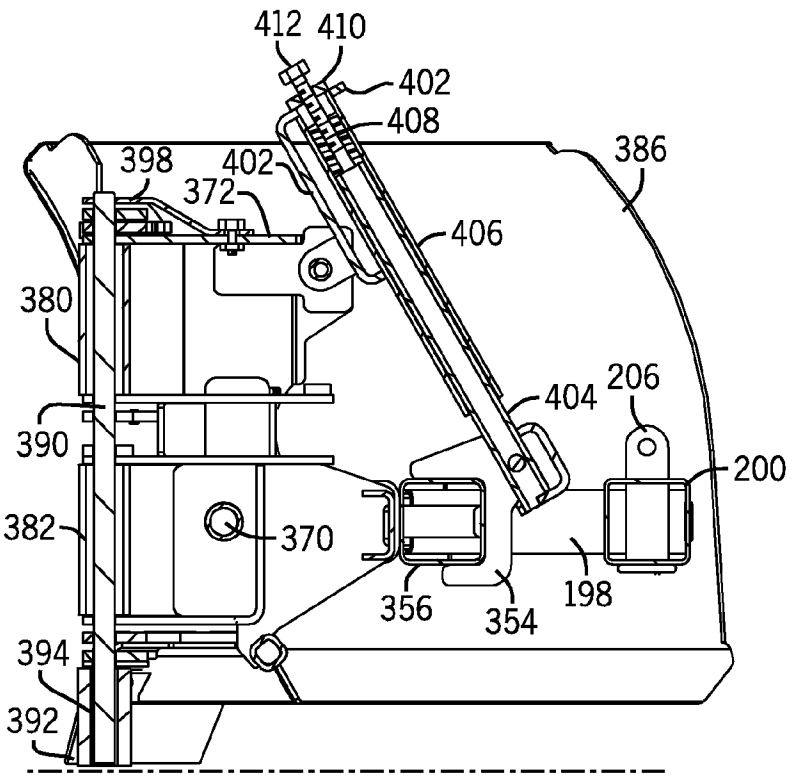
FIG. 26A is a cross sectional view along the line 26A-26A in FIG. 15 and illustrating the tower and tower adjustment assembly for a V-plow blade to maintain the lower edge of the blades in a horizontal aspect relative to the surface being cleaned.

FIG. 23 is rear isometric view of simply body of a V-plow snow plow 50. Each of the V-plow blades 386, 388 includes a plurality of plow ribs 268. Each of the plow ribs 268 are aligned vertically and coupled to a bottom plow frame member 262. The plow ribs 268 are positioned in evenly spaced intervals along the bottom plow frame member 262 and welded to the plow blade 250 in the bottom plow framed member. Each of the plow ribs 268 is configured in a concave curve to which the plow blade rib 286 conforms and which also facilitates movement of material, such as snow, as the plow 50 is operated. A wearstrip 270 is coupled to a substantial portion of the lower edge of each of the V-plow blades by a plurality of bolts 272 which extends through the wearstrip 270, the plow blade, the bottom plow frame member 262 and a nut plate 274 which is positioned against one of the downward extending flanges of the bottom plow frame member 262 (see at least FIG. 23). Reinforcement members 264 are positioned between the down facing flanges of the bottom plow frame member to reinforce the plow blade assembly. The reinforcement members 264 are typically welded to the bottom plow frame member 262. The top edge of the plow blade is bent and configured to be coupled to the top edge of each of the plow ribs 268. The top edge of the plow blade is typically welded to each of the plow ribs 268. As illustrated at least in FIGS. 15, 26*a* and 27 a tower adjustment assembly 400 is coupled to the plow tower 362 and the plow frame 170.

The tower adjustment assembly 400 includes a tower adjustment bracket 402 which is in a substantial T-shape. The top portion of the T-shape is coupled to an outer adjustment tube 406 at one end of the outer adjustment tube 406 and the lower portion of the T-shaped tower adjustment bracket 402 is also coupled to the outer adjustment tube 406 and is pivotably coupled to the plow tower 362 at the upper tower adjustment bracket 366 (see FIG. 17). A tower adjustment pin 414 secures the tower adjustment pivot bracket 402 on each side of the plow tower 362. An inner adjustment tube 404 is telescopically inserted into the outer adjustment tube 406 with the lower end of the inner adjustment tube 404 coupled to the lower tower adjustment bracket 352 on the tower traverse brace tube 352. The inner adjustment tube 404 does not extend throughout the full length of the outer adjustment tube 406. An adjustment cushion plug 408 is configured to fit within the inner diameter of the outer adjustment tube 406 and is inserted into the outer adjustment tube 406 between the inner adjustment tube 404 and the bolt bracket 410 coupled to the tower adjustment to the bracket 402. An adjustment bolt 412 is threadingly coupled to the adjustment cushion plug 408 through the bolt bracket 410. The adjustment cushion plug is preferably composed of a high density material such as polyurethane or other high density material.

In operation as the adjustment bolt 412 is turned, clockwise, into the inner and outer adjustment tube assembly. The adjustment bolt 412 pushes against the adjustment cushion plug 408 and forces the V-plow blades 386, 388 to pivot about the horizontal pivot pin 370 as illustrated schematically in FIG. 26*b*. The purpose of such adjustment is to maintain the lower edges of each of the V-plow blades 386, 388 in a substantially horizontal relationship to the surface which is being cleared of material by the plow 50. As the two segments of the V-plow are moved to various configurations (as described above) the outermost ends of each of the V-plows tend to move vertically relative to the plow hinge central section. The tower adjustment assembly counteracts such vertical movement and facilitates maintenance of a horizontal aspect of the lower edge of each of the blade segments.

Figure 27:
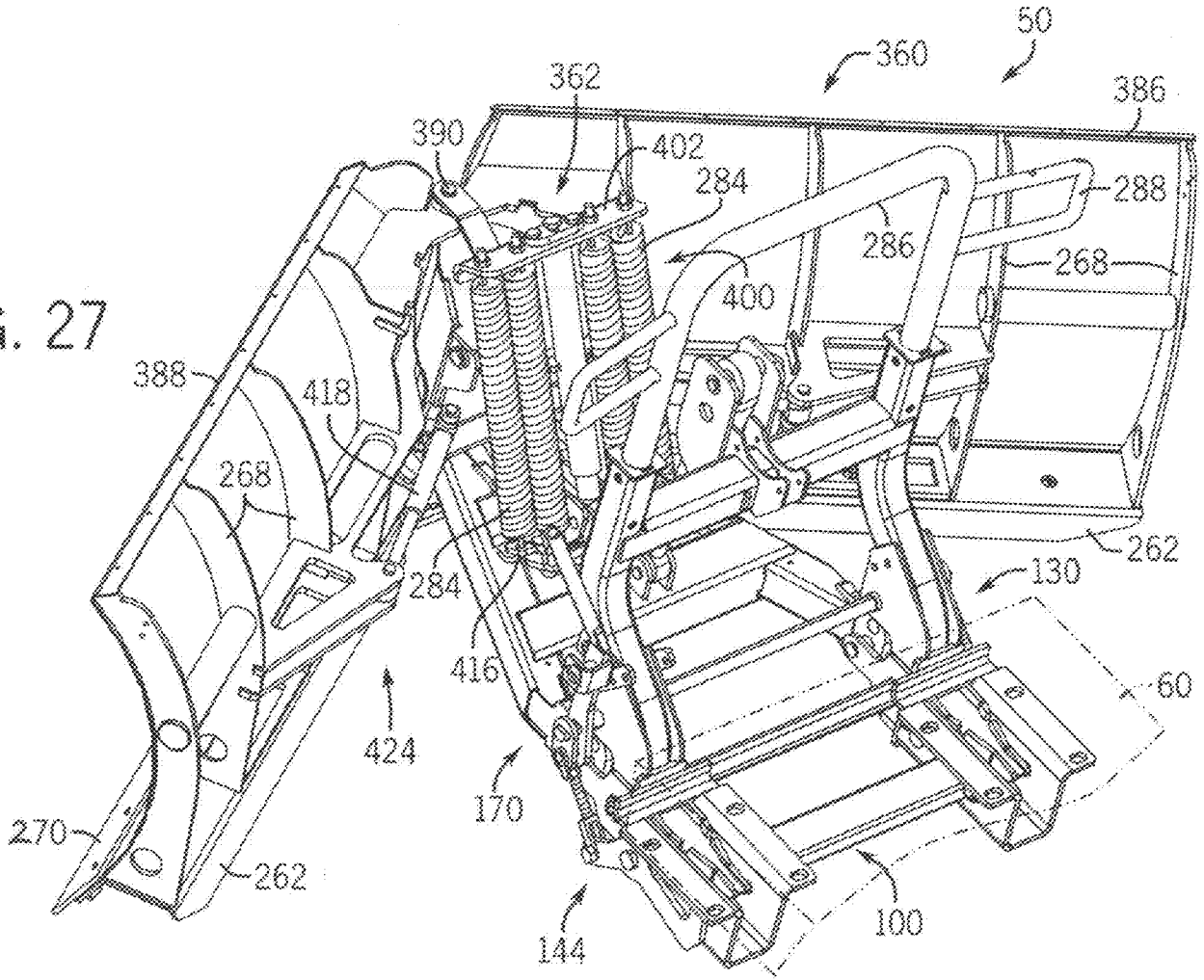
FIG. 27 is an isometric, assembly top view of an exemplary embodiment of the blade illustrated in FIG. 23.

As illustrated in FIG. 27, a plurality of trip springs 284 are coupled to each of the lower trip spring brackets 416 and the tower adjustment pivot bracket 402. FIG. 27 also illustrates a light bar 286 coupled to the lift bar support brackets 132. The light bar 286 supports a plurality of light brackets 288 to which plow lights (not shown) are coupled. Plow lights are typically needed since the snow plow 50 typically obstructs the headlights of the vehicle to which the snow plow is coupled. The trip springs 284 bias the plow tower 362 during operation of the plow 50 to return the V-plow blades 386, 388 to their operative position after the plow blade encounters an obstruction in the surface being cleared.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of a quick connect/disconnect hitch and a plow with independently moveable wings has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the hitch or plow as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A V-plow including a first blade and a second blade, with each pivotably connected about an axis and movable through a range of movement, the V-plow comprising:

a first wearstrip and a second wearstrip, the first wearstrip being coupled to the first blade and the second wearstrip being coupled to the second blade;

a first flange portion extending from the first wearstrip and a second flange portion extending from the second wearstrip;

a wearstrip cylinder coupled to the first flange portion, the wearstrip cylinder being aligned with the axis; and the second flange portion extending towards the wearstrip cylinder and the axis;

wherein the second flange portion and the wearstrip cylinder are arranged to minimize a gap defined therebetween throughout the range of movement.

2. The V-plow of claim 1, wherein the wearstrip cylinder is configured integral with the first flange portion and the first wearstrip as a single member.

3. The V-plow of claim 2, wherein the wearstrip cylinder is welded to the first flange portion.

4. The V-plow of claim 1, wherein the wearstrip cylinder is configured as a hollow tube of constant radius.

5. The V-plow of claim 1, including a blade vertical pivot pin configured to couple the first and second blades and the wearstrip cylinder together.

6. The V-plow of claim 1, including a convex bulge defined by each of the first V-plow blade and the second V-plow blade proximate the axis, with each convex bulge configured to direct material away from the axis.

7. The V-plow of claim 1, wherein the first wearstrip is bolted to the first blade and the second wearstrip is bolted to the second blade.

8. The V-plow of claim 1, wherein the second flange portion and the second wearstrip define an angle therebetween.

9. The V-plow of claim 8, wherein the second flange portion is configured closely adjacent to the wearstrip cylinder, throughout the range of movement of the blades.

10. The V-plow of claim 1, including a plow frame configured to couple the blades to a vehicle.

11. The V-plow of claim 1, wherein the wearstrip cylinder is of generally constant diameter.

12. A snow plow comprising:

a hitch frame nose assembly configured to couple to a vehicle;

a plow frame coupled to the hitch frame;

a first V-plow blade and a second V-plow blade, each pivotably coupled to a plow tower with a horizontal pivot pin, the plow tower connected to the plow frame and configured to support each of the V-plow blades for independent movement, through a range of movement about an axis;

a pair of wearstrips with one wearstrip coupled to each of the first V-plow and second V-plow blade; and a wearstrip cylinder coupled to at least one of the wearstrips, with the wearstrip cylinder aligned with the axis, wherein the orientation of the first and second V-plow blades, the wearstrips and the wearstrip cylinder minimize a gap defined between the two V-plow blades throughout the range of movement and wherein the snow plow is pivotably coupled to the vehicle.

13. The snow plow of claim 12, wherein the wearstrip cylinder is configured integral with the one wearstrip as a single member.

14. The snow plow of claim 13, wherein the wearstrip cylinder is welded to the one wearstrip.

15. The snow plow of claim 12, wherein the wearstrip cylinder is configured as a hollow tube.

16. The snow plow of claim 15, including a vertical pivot pin configured to couple the first and second blades and the wearstrip cylinder together.

17. The snow plow of claim 1, including a convex bulge defined by each of the first v-plow blade and the second v-plow blade proximate the axis, with each convex bulge configured to direct snow away from the axis.

18. The snow plow of claim 12, wherein one wearstrip is bolted to the first blade and the other wearstrip is bolted to the second blade.

19. The snow plow of claim 12, including a flange coupled to each of the wearstrips and defining an angle between the flange and the wearstrip.

20. The snow plow of claim 19, wherein one flange is coupled to the wearstrip cylinder and the other flange is closely adjacent to the wearstrip cylinder, throughout the range of movement of the blades.

21. The snow plow of claim 12, wherein the wearstrip cylinder is of generally constant diameter.

22. A cutting edge interface for a v-plow including a first blade and a second blade, with the blades coupled together about an axis by a vertical pivot pin and moveable through a range of movement, the cutting edge interface comprising:

a pair of wearstrips with one wearstrip coupled to each of the first and second blade, each wearstrip configured with a flange defining an angle between the flange and a straight portion of the wearstrip; and a wearstrip cylinder coupled to at least one of the wearstrips, with the wearstrip cylinder aligned with the axis, wherein the pair of wearstrips and the wearstrip cylinder minimize a gap defined between the two blades, and wherein one flange is coupled to the wearstrip cylinder and the other flange is closely adjacent to the wearstrip cylinder throughout the range of movement of the blades.

23. The cutting edge interface of claim 22, including a convex bulge defined by each of the first blade and second blade proximate the axis, with each convex bulge configured to direct material away from the axis.

* * * * *